US009322209B1

(12) United States Patent
Schwind et al.

(10) Patent No.: US 9,322,209 B1
(45) Date of Patent: Apr. 26, 2016

(54) INSULATING WINDOW PANEL

(71) Applicants: Gregory A. Schwind, Rocky River, OH (US); Ronald A. Greene, North Royalton, OH (US)

(72) Inventors: Gregory A. Schwind, Rocky River, OH (US); Ronald A. Greene, North Royalton, OH (US)

( * ) Notice: Subject to any disclaimer, the term of this patent is extended or adjusted under 35 U.S.C. 154(b) by 0 days.

(21) Appl. No.: 14/689,060

(22) Filed: Apr. 17, 2015

Related U.S. Application Data

(60) Provisional application No. 62/086,181, filed on Dec. 1, 2014.

(51) Int. Cl.

| | |
|---|---|
| ***E06B 5/00*** | (2006.01) |
| ***E06B 1/36*** | (2006.01) |
| ***E04B 1/76*** | (2006.01) |
| ***E06B 3/06*** | (2006.01) |
| ***E06B 3/54*** | (2006.01) |

(52) U.S. Cl.
CPC ... *E06B 5/00* (2013.01); *E04B 1/76* (2013.01); *E06B 1/36* (2013.01); *E06B 3/06* (2013.01); *E06B 3/549* (2013.01)

(58) Field of Classification Search
CPC ..... E06B 1/36; E06B 1/76; E06B 3/06; E06B 6/549; E06B 3/50; E06B 5/00
See application file for complete search history.

(56) References Cited

U.S. PATENT DOCUMENTS

| | | | | | |
|---|---|---|---|---|---|
| 2,578,470 | A | * | 12/1951 | Gorell et al. | 52/202 |
| 3,137,088 | A | * | 6/1964 | Spertus | 160/378 |
| 3,826,053 | A | * | 7/1974 | Cameron | 52/309.1 |
| 4,193,235 | A | * | 3/1980 | Cucchiara | 52/202 |
| 4,441,290 | A | * | 4/1984 | Abell | 52/202 |
| 4,453,585 | A | * | 6/1984 | Ruggeberg et al. | 160/354 |
| 4,656,785 | A | * | 4/1987 | Yackiw | 49/495.1 |
| 5,090,835 | A | * | 2/1992 | Cox | 403/294 |
| 5,737,885 | A | * | 4/1998 | Stoyke | 52/202 |
| 5,752,297 | A | * | 5/1998 | Ramey | 24/462 |
| 2008/0078131 | A1 | * | 4/2008 | Grimes | 52/202 |

FOREIGN PATENT DOCUMENTS

EP 2 840 222 A1 * 2/2015

* cited by examiner

*Primary Examiner* — Jeanette E Chapman
(74) *Attorney, Agent, or Firm* — D.A. Stauffer Patent Services LLC

(57) ABSTRACT

An insulating window panel for removable installation into a custom size window opening recess includes longitudinally extending frame pieces configured with joints for interconnecting the frame pieces to form a frame around a transparent flexible glazing sheet. Each frame piece has a longitudinal keder channel with a slot that opens out of a glazing side of each frame piece. The glazing sheet has edges corresponding to the frame pieces; and a keder formed on each of the edges, with a corner cut that spaces apart intersecting kedered edges, all being shaped and sized for sliding each keder edge into the keder channel of each corresponding frame piece such that the frame pieces form joints at the corner cuts and the frame pieces are pulled together at the joints by tension relative to the glazing sheet. Preferably a weatherstrip surrounds the frame perimeter with compressible fins for sealed but removable installation.

17 Claims, 13 Drawing Sheets

INSULATING WINDOW PANEL

CROSS-REFERENCE TO RELATED APPLICATIONS

This application claims the benefit of U.S. Provisional Patent Application No. 62/086,181, filed Dec. 1, 2014, said application hereby incorporated in its entirety by reference herein.

BACKGROUND OF THE INVENTION

While windows are a desirable architectural detail in buildings, they typically account for 30% of heating and cooling costs. Double pane windows help reduce heat transfer and were originally achieved by hanging a second (single pane) window over the outside of the existing window; however they couldn't be opened, so this was for winter use and known as a "storm window". A more convenient alternative is a multi-pane permanent replacement window, but this is much more expensive. For the less expensive storm window approach the difficulty of seasonally installing and removing exterior storm windows was at least partly addressed by converting to double or triple track storms that could be opened and closed from inside the house. Finally, to avoid the cost of multi-track storm windows, insulating window panels have been developed as interior storm windows, which are much easier to seasonally install and remove. These take many forms from permanent to semi-permanent to temporary (e.g., flimsy heat shrinking plastic sheets). Other than the largely unsatisfactory temporary kind, insulating window panels (storm windows) for interior or exterior use are generally either expensive, or bulky and difficult to employ. Also, in most cases a storm window must be custom made to fit in an existing window opening, and therefor either requires a degree of skill to make and install it, or it must be shipped in a full size assembled state, which can be relatively expensive, and then it requires skilled installation, generally using some kind of mechanical fastener that can mar the existing window trim.

Thus there is a need for improved means and methods for insulating existing windows in a cost effective manner. It is an object of the present invention to reduce the cost of window insulation products, while maintaining the convenience and effectiveness of the better forms of prior art storm windows.

BRIEF SUMMARY OF THE INVENTION

According to the invention a relatively inexpensive but reusable, light weight, transparent insulating window panel is provided. The window panel is easily installed over an existing window to slow the transfer of heat and cold through window openings thus saving energy. When window insulation is not needed, it is easily removed and stored for reuse as needed.

The inventive window panel is cost reduced by a design that enables a method wherein a consumer/user of ordinary skill and strength can order a custom size insulating window panel, then receive, install, remove, and store the product by themselves.

Each insulating window panel is made to order to fit each existing window opening individually according to a set of measurements that are simplified for being made by the user and specified in a purchase order. The individual custom sized insulating window panels are prefabricated offsite to specified size as a kit of unassembled finished components, packaged to ship in a compact form that the end user can easily assemble and install with no special skills or tools being required.

According to the invention the insulating window panel is provided as a transparent window in an attractive thin frame surrounded by a resilient weatherstrip is sealingly and removably mounted inside or outside of the existing window for trapping an insulating volume of air between panel and window. The window panel reduces heating and cooling costs and increases comfort by eliminating drafts. A reduction in interior condensation is also possible as is a degree of exterior noise abatement, and enhanced visual appearance of the existing window.

The disclosed insulating window panel will benefit a wide range of users including: homeowners, landlords, property managers, apartment dwellers, renters, historical preservationists, etc.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views presented herein may be in the form of "slices", or "near-sighted" cross-sectional views, omitting certain background lines which would otherwise be visible in a true cross-sectional view, for illustrative clarity. Also for clarity, cross-sectional shading may be omitted on section edges of thin or multiple parallel layers. Omitted shading may not be explicitly noted, but may be assumed wherever it is obvious, unless specifically noted to the contrary.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different versions of an element 109 which are similar or related in some way but are separately referenced for the purpose of describing modifications to the parent element (109). Such relationships, if any, between similar elements in the same or different figures will become apparent throughout the specification, including, if applicable, in the claims and abstract.

Figure 1:
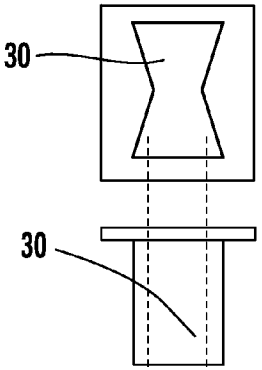
Figure 1:
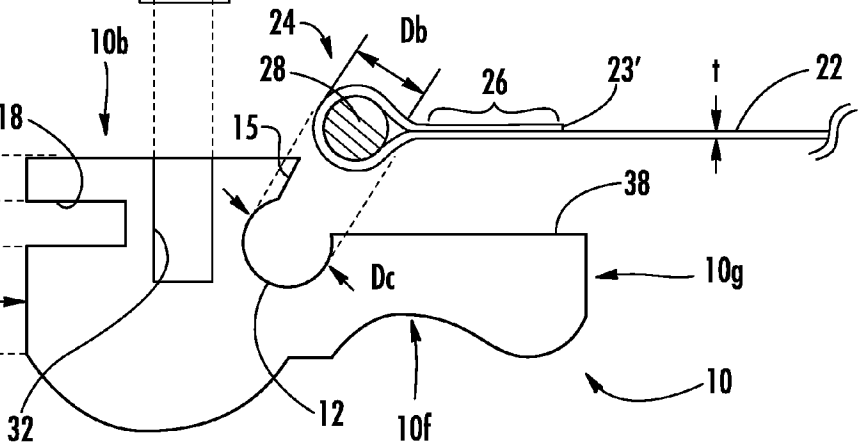

The structure, operation, and advantages of the present preferred embodiment of the invention will become further apparent upon consideration of the following description taken in conjunction with the accompanying drawings, wherein:

FIG. 1 is an end, exploded view of main components of an insulating window panel, shown in assembly relationship by dashed connecting lines, all according to the present invention.

Figure 2:
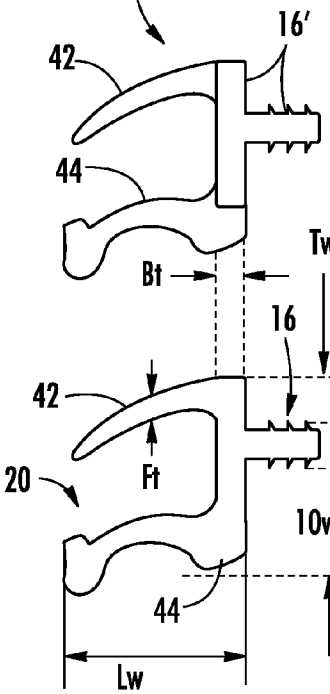

FIG. 2 is a end view of another embodiment of a weatherstrip component, all according to the present invention.

Figure 3:
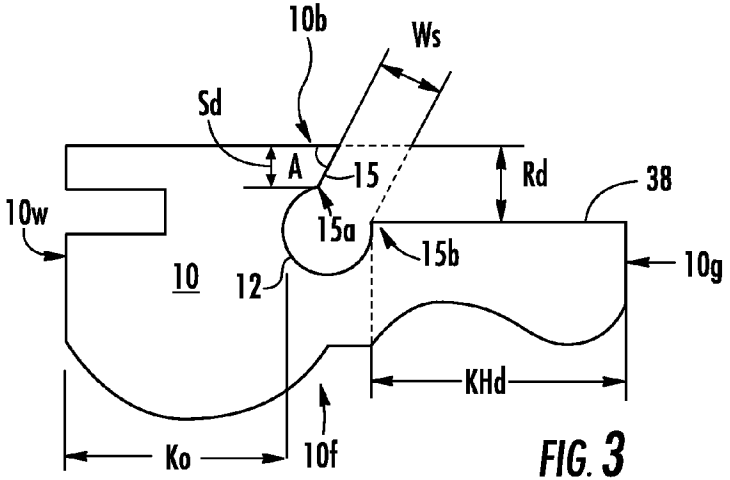

FIG. 3 is an end view of the frame piece component of FIG. 1, showing reference numerals for some dimensional details, all according to the present invention.

Figures 4, 5:
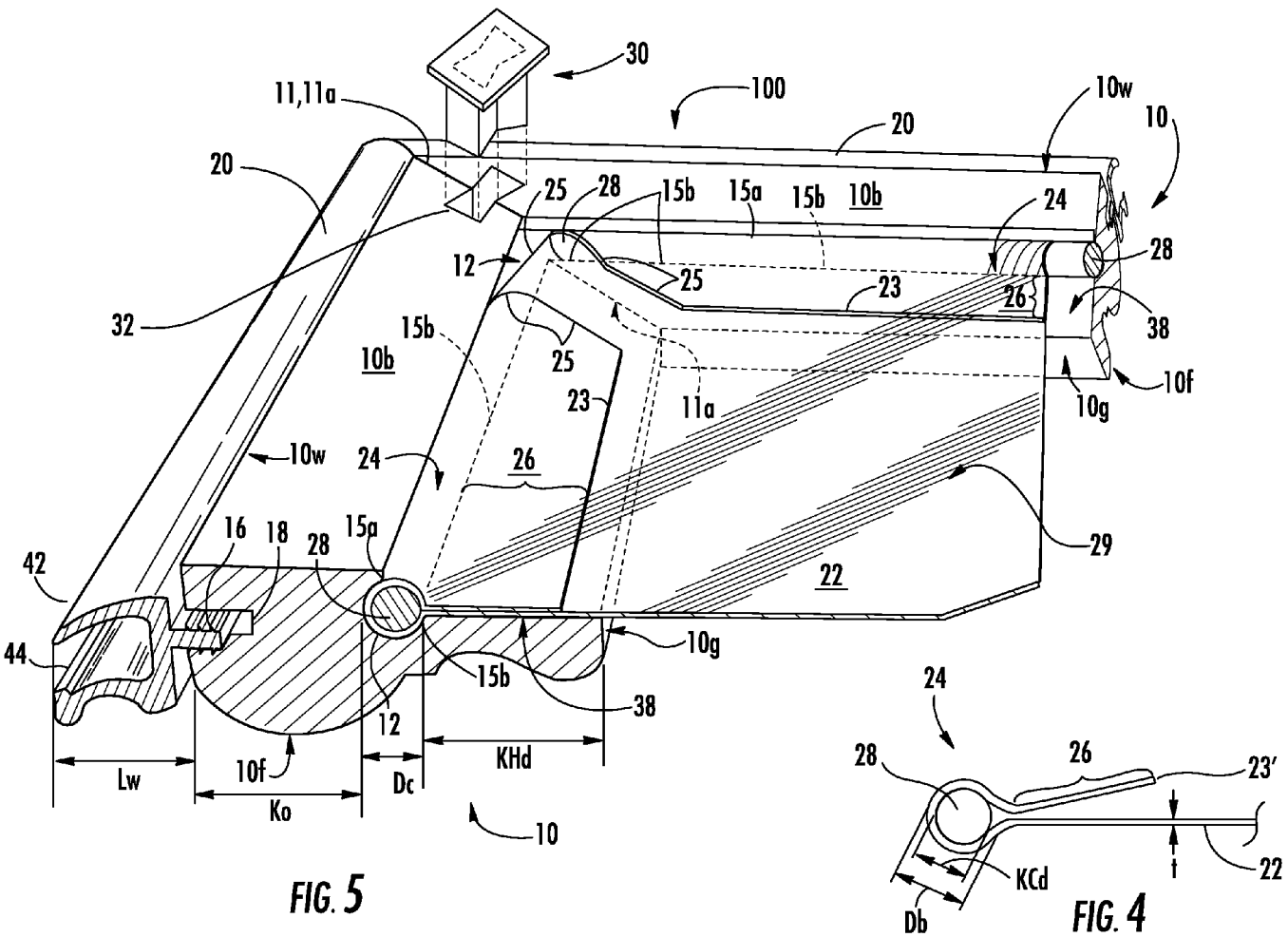

FIG. 4 is an end view of a keder being formed on a flexible window glazing sheet, all according to the present invention.

FIG. 5 is a back, inside perspective view of a cutaway corner portion of an assembled insulating window panel, all according to the present invention.

Figure 6:
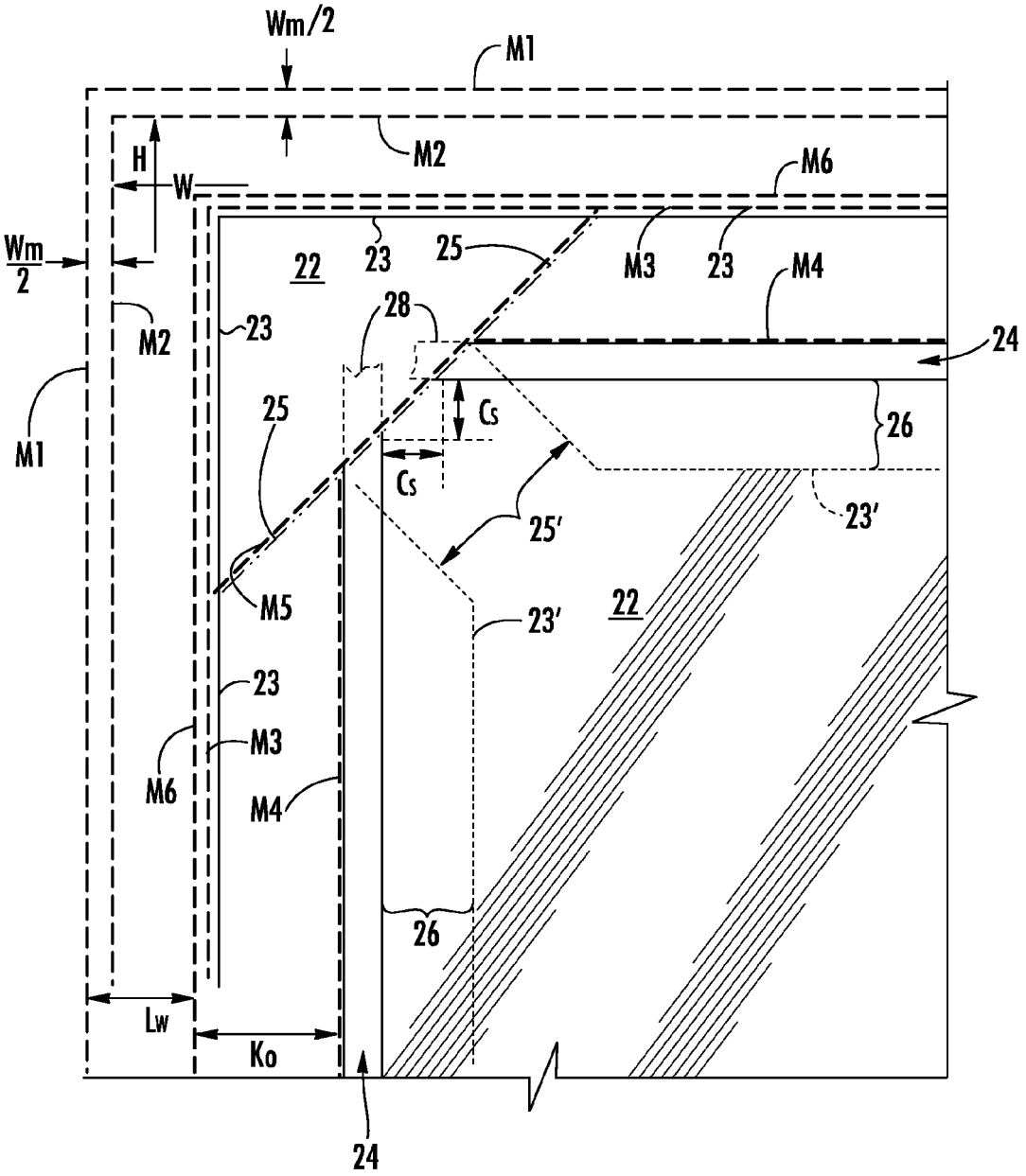

FIG. 6 is a schematic view of a manufacturing template corner portion, which illustrates relative locations of components and cuts made in them, all according to the present invention.

Figure 7:
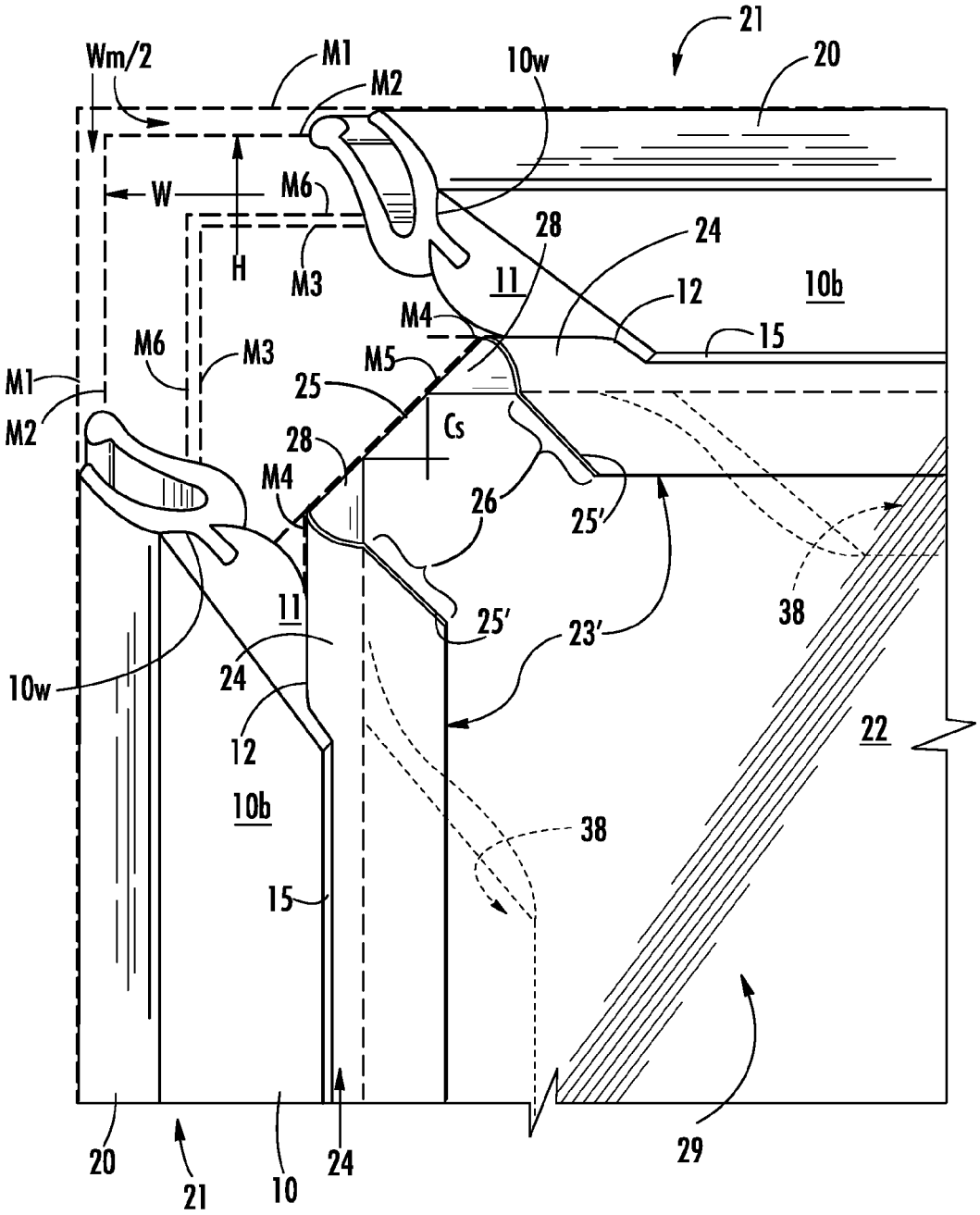

FIG. 7 is an aerial view of frame and glazing sheet components positioned on the template of FIG. 6, all according to the present invention.

Figure 8:
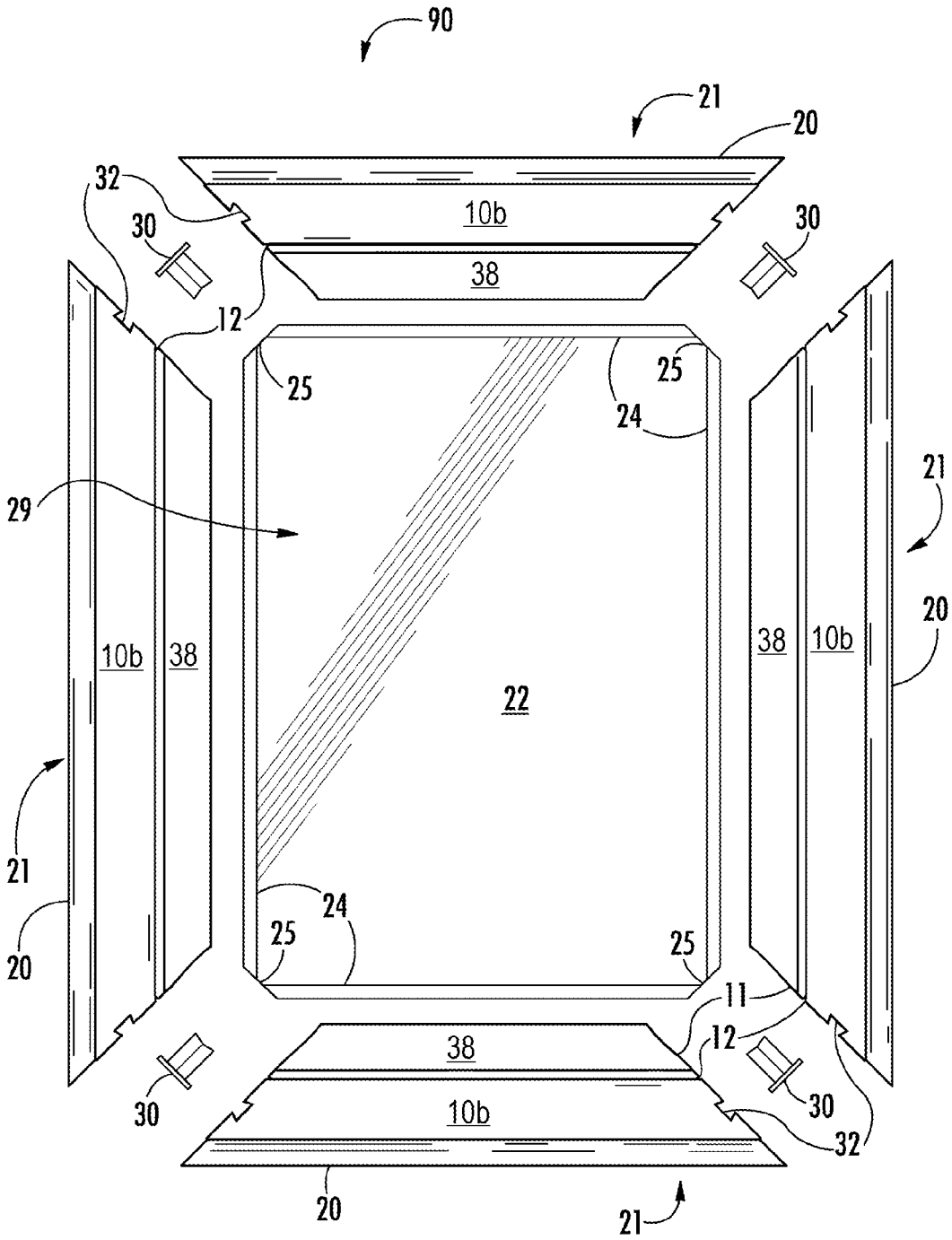

FIG. 8 is a plan view of a prefabricated custom sized window panel shown as an unassembled kit, all according to the present invention.

Figure 9A:
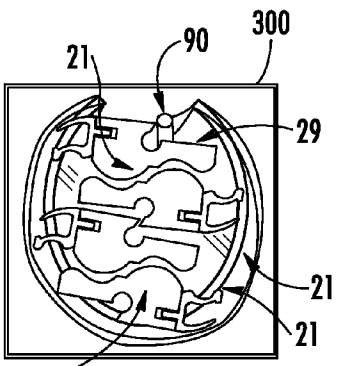
Figure 9B:
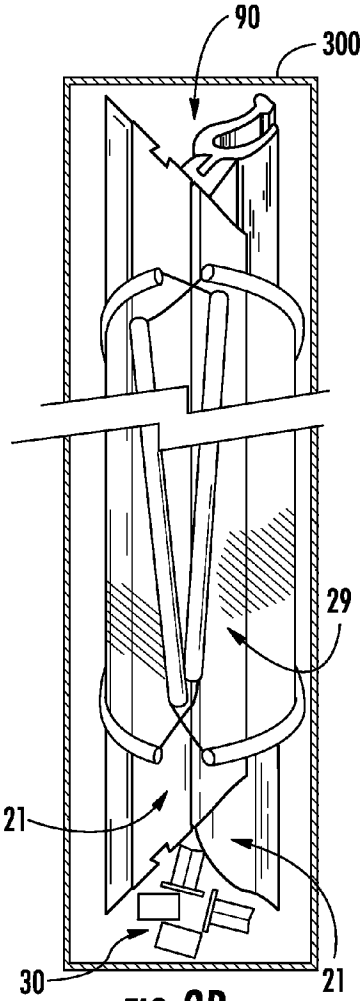

FIGS. 9A-9B are end, and side views, respectively of the kit of FIG. 8 after bundling into a compact linear form for convenient boxing and shipping, all according to the present invention.

Figure 10A:
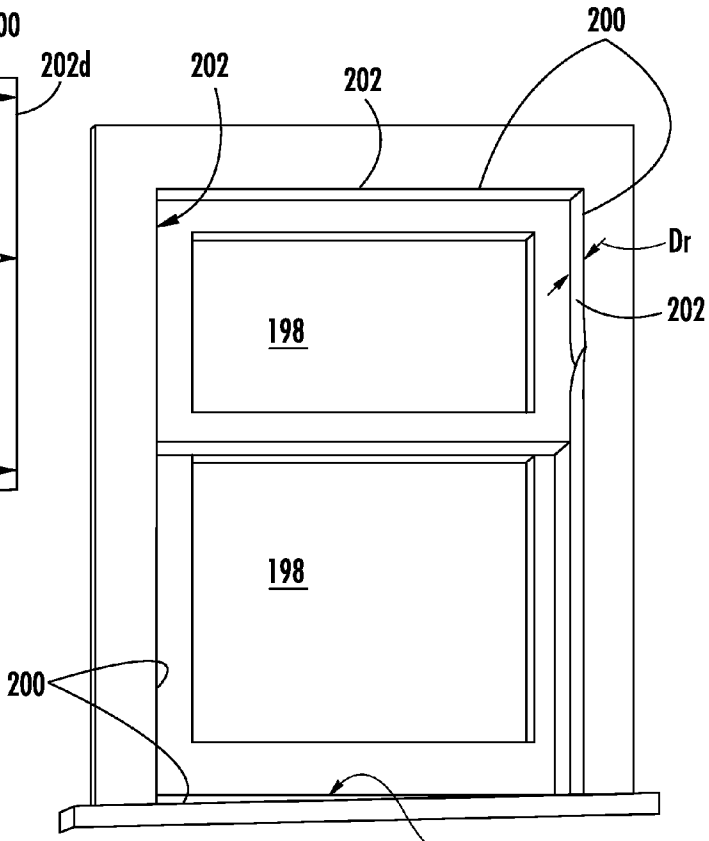

FIG. 10A is a side perspective view of a user's existing custom size, built-in window showing a window opening recess into which an insulating window panel may be installed, all according to the present invention.

Figure 10B:
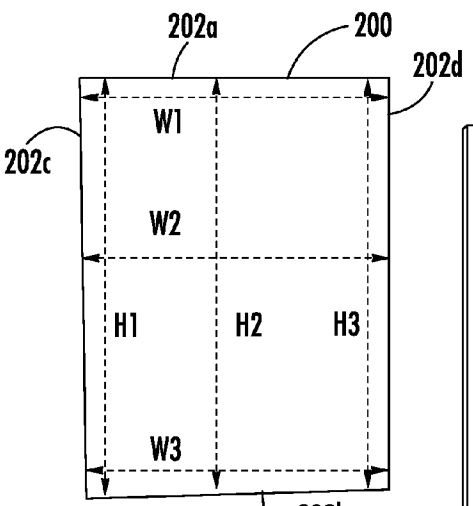

FIG. 10B is a side elevation view of the window opening of the window of FIG. 10A, showing exemplary dimension measurements, all according to the present invention.

Figure 11:
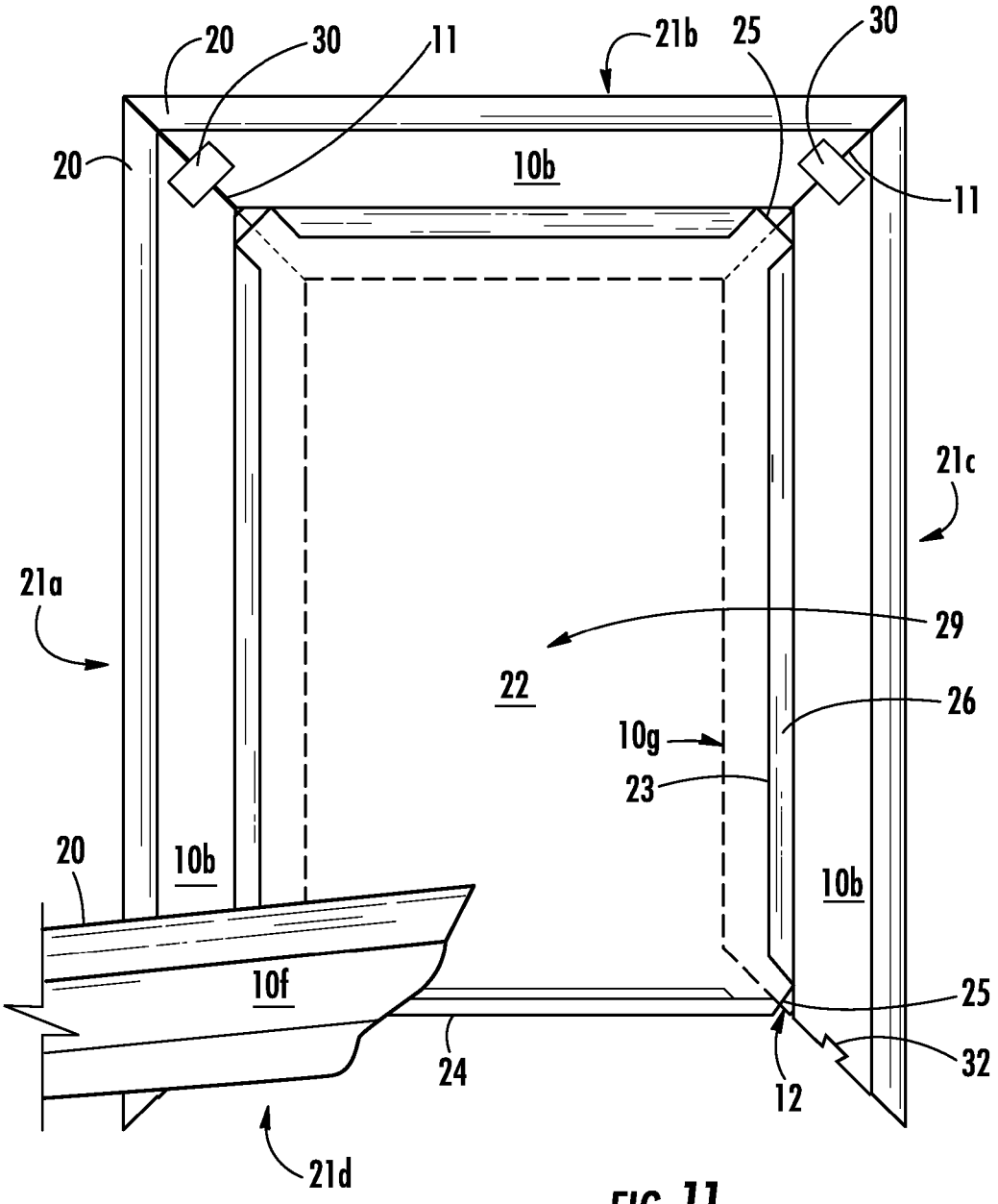
Figure 13:
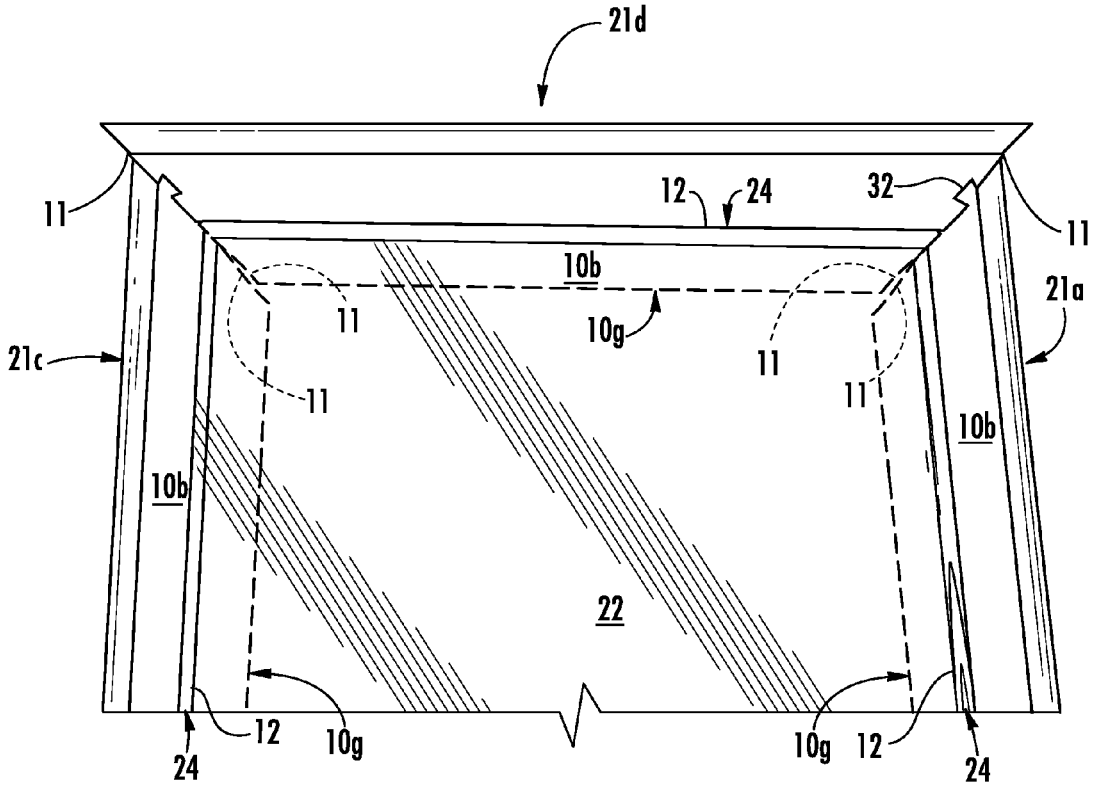
Figure 14:
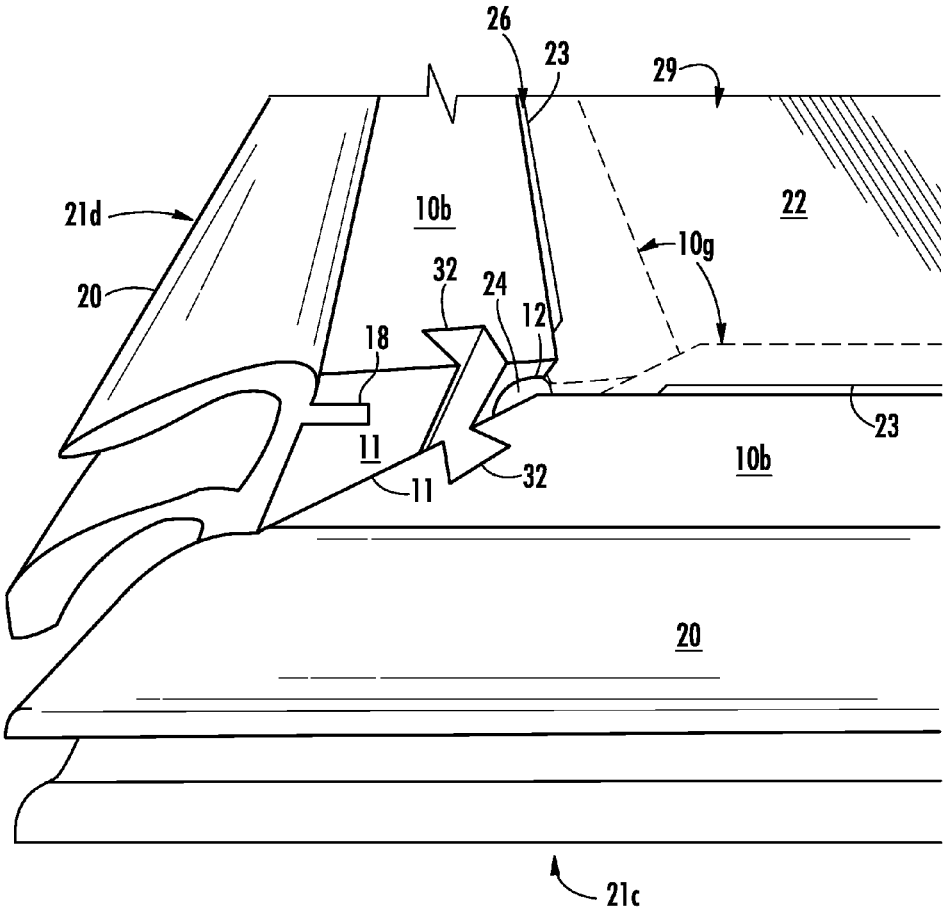

FIGS. 11, 13, 14 are backside perspective views of a final frame piece being assembled to complete assembly of the insulating window panel, all according to the present invention.

Figure 12:
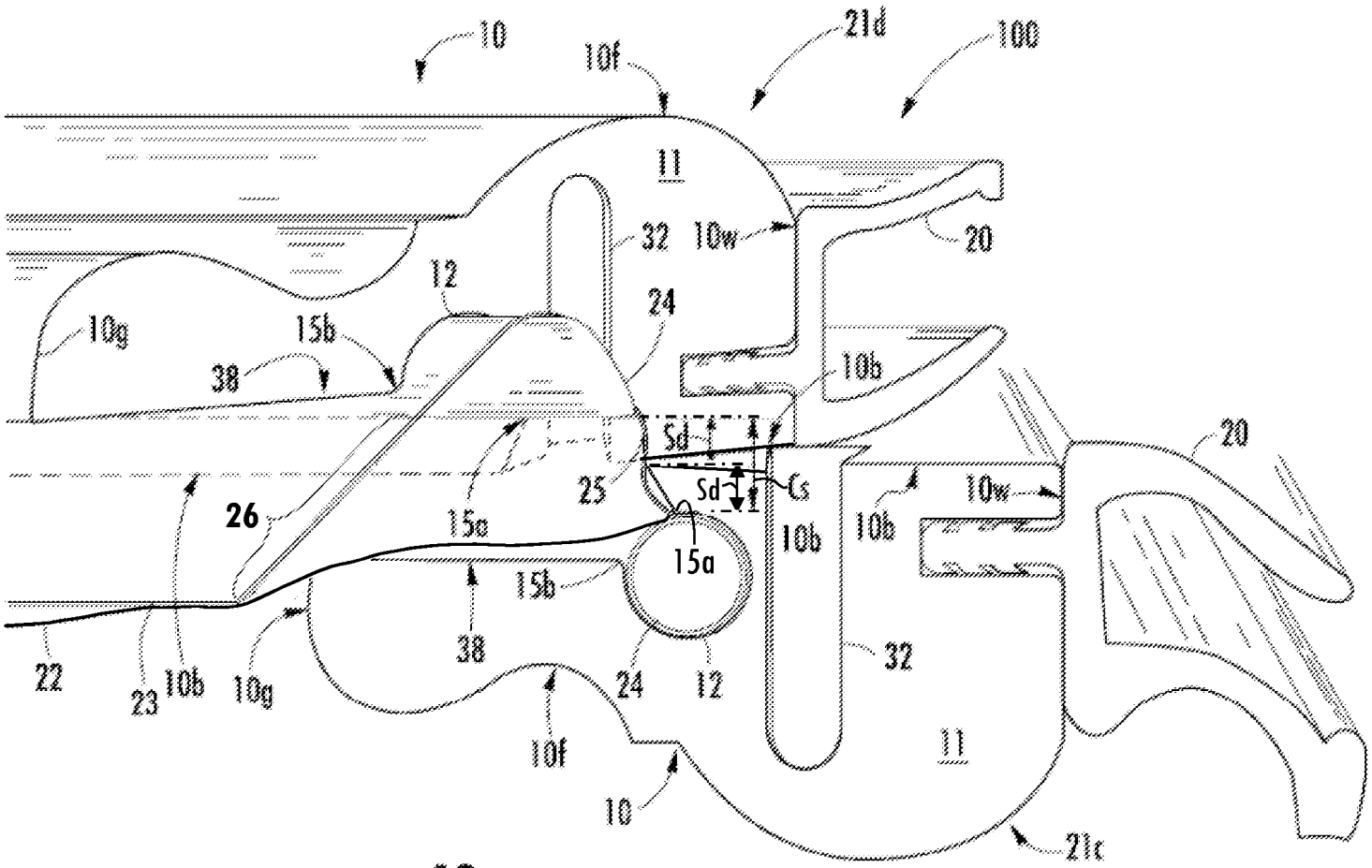

FIG. 12 is a magnified back, end view of two frame pieces during assembly of the insulating window panel, all according to the present invention.

Figures 15A, 15B, 15C, 15D, 15E:
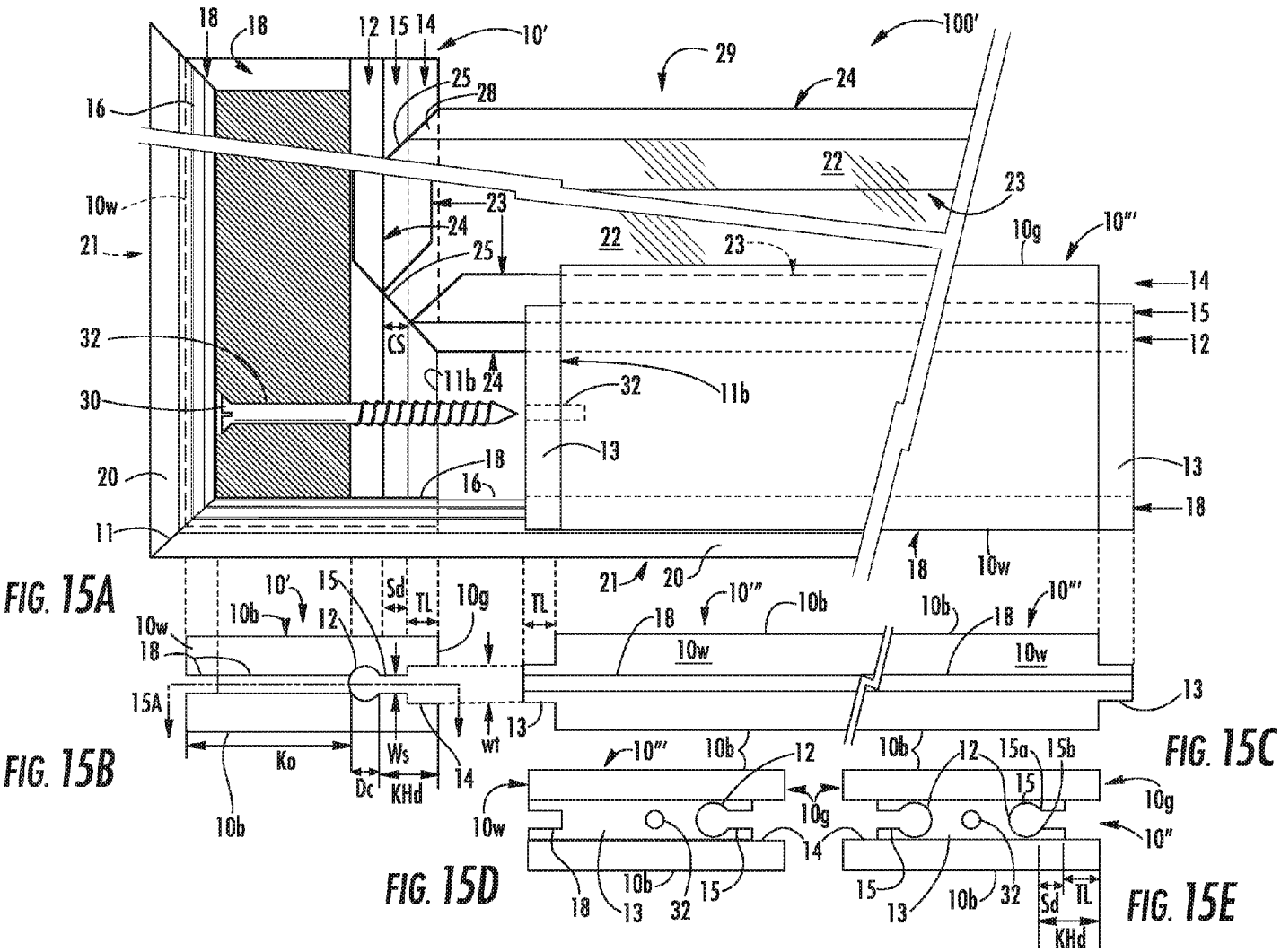

FIG. 15A is a plan view of a reinforced butt joint being completed by assembling a stile frame piece, shown in cross-section, and a rail frame piece, all according to the present invention.

FIG. 15B is an end view of the stile frame piece in FIG. 15A, with the cross-section view direction of FIG. 15A being indicated by the line 15A-15A, all according to the present invention.

FIG. 15C is a view of the weatherstrip side of the rail frame piece in FIG. 15A, all according to the present invention.

FIG. 15D is an end view of the rail frame piece in FIG. 15A, all according to the present invention.

FIG. 15E is an end view of a muntin frame piece showing differences compared to the rail frame piece, all according to the present invention.

Figure 16:
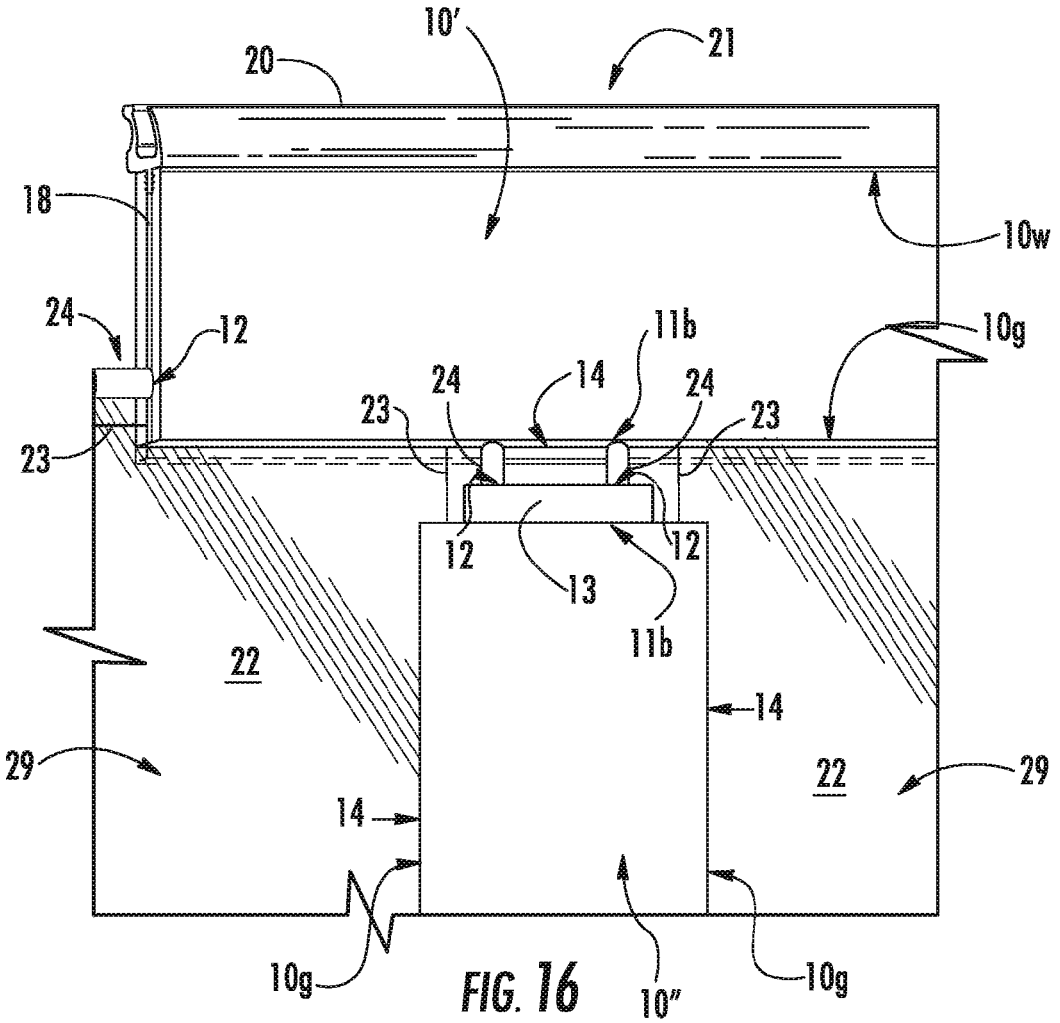

FIG. 16 is a top perspective view of a muntin frame piece being joined with a stile frame piece, all according to the present invention.

Figure 17:
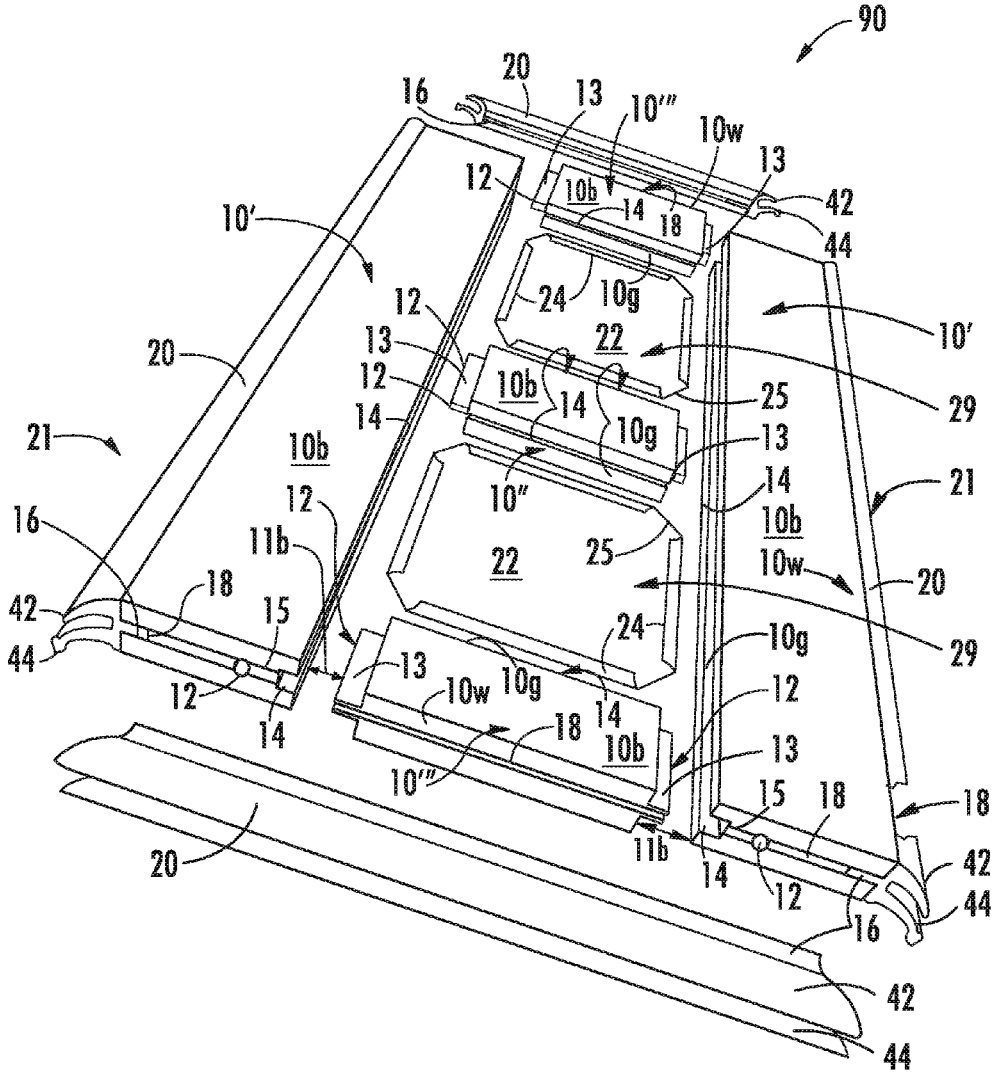

FIG. 17 is a top, end perspective view of a prefabricated custom sized window panel shown as an unassembled kit, all according to the present invention.

DETAILED DESCRIPTION OF THE INVENTION

Reference Number Key:

| Ref. No. | Term |
|---|---|
| | COMPONENTS, FEATURES AND ASPECTS: |
| 10 | frame piece (section, member), or assembled frame of an insulating window panel made of interconnected (adjoined) frame pieces. Typical frame pieces 10 are the same shape except for length, have mitered end joints 11a, and form a perimeter frame around a kedered glazing sheet 29 (window pane) when assembled. For optimum strength and appearance, preferred dimensions for frame pieces include a width of about 1½" or 2", and a thickness of about ¾". |
| 10', 10", 10"' | Rugged frame pieces, distinguished by the use of reinforced butt joints 11b. Preferably the glazing side(s) 10g have a keder channel 12 with keder slot 15 leading outward through a butt joint groove 14 (female part of a tongue and groove form of reinforced butt joint 11b). 10' and 10"' = stile and rail frame pieces, respectively. Has a glazing side 10g and a weatherstrip side 10w (with a weatherstrip receiving groove 18). Connected to each other to form a perimeter frame of weatherstripped frame pieces 21. 10" = muntin bar frame piece for use between any of the rugged frame pieces 10', 10", 10"'. Used as an intermediate crosspiece rather than as part of a perimeter frame. Has two glazing sides 10g and no weatherstrip side 10w. Both the rail 10"' and the muntin frame pieces 10" have joint ends, preferably configured as a tongue 13 that mates with a tongue receiving butt joint groove 14 to form a tongue and groove type of reinforced butt joint 11b. |
| 10b, 10f, 10g, 10w | frame sides: back side, front side, glazing side, and weatherstrip side, respectively. |
| 11 | frame joint(s) = abutting frame piece faces where frame pieces 10 interconnect (are adjoined). May also be used to reference frame piece ends where appropriate. |
| 11a | 11a = mitered joint (typical for indoor use) |
| 11b | 11b = reinforced butt joint, preferably a tongue and groove (mortise/tenon) joint. Preferred for exterior or rugged or large window panels. Enables use of muntin bar frame pieces 10". |
| 12 | keder channel, extends lengthwise within a frame piece 10. |
| Dc | Dc = channel diameter |
| Ko | Ko = keder offset, widthwise distance that channel 12 is offset from the frame weatherstrip side 10w. (e.g., about ⅝" +/− 1/16" ) |

-continued

| Reference Number Key: | |
|---|---|
| Ref. No. | Term |
| KHd | KHd = keder hem depth, widthwise distance from the keder channel 12 to the frame glazing side 10g. It covers keder hem 26 and corner cut 25 (e.g., about 5/8" +/− 1/16" ) |
| 13 | male part of a reinforced butt joint 11b, e.g., tongue of a tongue and groove butt joint. It extends longitudinally out from a longitudinal end of a suitable form of frame piece (e.g., tongued crosspieces such as the rail 10''' and the muntin 10'' frame pieces.) |
| TL | TL = tongue length, and nominal depth of mating groove 14. |
| Wt | Wt = tongue thickness, and nominal width of mating groove 14. Must be at least as wide as a keder bead diameter Db to accommodate a perpendicular kedered edge 24 during frame assembly. |
| 14 | female part of a reinforced butt joint 11b, butt joint groove, e.g., a tongue-receiving groove part of a tongue and groove reinforced butt joint. It is recessed along the glazing side 10g of a suitable form of frame piece (e.g., stile frame pieces 10' , and also both rail 10''' and muntin 10'' frame pieces if vertical muntin frame pieces 10'' are to be used). |
| 15 | keder slot - defines opening in keder channel for the keder neck/hem 26 and glazing sheet 22 to extend. (Initially cut at about 45 degree angle vs. back side 10b of mitered frame pieces 10 or about 0 degrees out through the glazing side 10g of rugged frame pieces 10', 10'', 10''') |
| 15a, b | holding edges of keder channel 12 on either side of the intersection with the keder slot, separated by slot width Ws |
| Ws | Ws = slot width (e.g., about 1/8") |
| Sd | Sd = slot depth from entrance to exit of slot. For mitered frame pieces 10, this is the perpendicular distance from frame back 10b to holding edge 15a at slot entrance (e.g., about 1/16") |
| 16, 16' | weatherstrip barb, may include base of weatherstrip fins, preferably has holding ridges making the barb slightly wider than the weatherstrip groove 18. The base portion lies across the frame weatherstrip edge 10w to separate the fins 42, 44.<br>16, 16' = two embodiments made from different Durometer materials (see 20, 20' ). |
| 18 | weatherstrip receiver/groove along weatherstrip side/edge 10w of perimeter frame pieces 10, 10', 10''' (e.g., about 1/8" wide × 1/4" deep) |
| 20 | flexible/compression weatherstrip (combined 16, 42, 44), perimeter gasket or weatherstrip |
| 20' | 20' = a weatherstrip embodiment made from two different Durometer materials (softer for fins 42, 44, and relatively stiff for base/barb 16') |
| Lw | Lw = weatherstrip outward (lateral) extension width (e.g., about 1/2"). |
| Tw | Tw = weatherstrip height at its base, approximately equal to height of frame weatherstrip side 10w (i.e., about 1/2") |
| Bt | Bt = weatherstrip base thickness (e.g., about 1/16") |
| Wm | Wm = weatherstrip margin = amount of outside panel dimensions (including the weatherstrip 20) that exceeds the maximum height and width dimensions of the window opening 200. (e.g., about 1/8" total compression of weatherstrip at maximum opening dimensions H × W).<br>Note: weatherstrip length is enough to fill and seal the window opening corners at the frame joints 11. |
| 21 | weatherstripped frame piece = prefabricated custom length perimeter frame piece 10 combined with its weatherstrip 20 - ready to ship to user/assembler. |
| 22 | glazing, glazing sheet, sheet material, preferably a flexible transparent film, but could be other flexible materials, like screening, or even rigid plastic glazing (see rabbet 38) |
| t | t = glazing sheet thickness (8-20 mil, preferably about 15-16 mil PVC) |
| 23 | edge of glazing sheet that has been cut to a custom shape and size that is dimensioned according to a predetermined relationship with the custom window dimensions H × W. |
| 23' | the free end of a glazing sheet after it is wrapped around a keder core to make a keder |
| 24 | keder, bead, or keder edge of the kedered glazing sheet 29 = a self-keder of glazing sheet 22 wrapped on core 28, and welded to form a hem 26 |
| Db | Db = keder bead diameter (diameter of keder) |
| 25 | corner cut that spaces apart two keders where they meet at a frame joint. This enables a keder to be lifted up enough to insert in channel of a mitered frame piece that is sliding across another frame piece already assembled on its keder. Also, in rugged frame pieces, provides separation between keders on either end of the keder slot 15 |
| Cs | Cs = corner cut spacing measured between cut ends of keders, perpendicular distance from side of one keder to end of the other keder = no less than 2 times the slot depth Sd for mitered frame pieces 10, or 1 times Sd for rugged frame pieces, and no more than the keder hem depth KHd (see keder channel 12). |

-continued

| Reference Number Key: | |
|---|---|
| Ref. No. | Term |
| 26 | keder hem (welded), sheet overlap area |
| 28 | keder core |
| KCd | KCd = keder core diameter (e.g., about 0.190") |
| 29 | kedered sheet, window pane = prefabricated custom sized glazing sheet after keders 24 are formed along the edges). |
| 30 | joint lock, locking key that bridges and stabilizes a frame joint 11. Fits into a mating keyhole 32. Both lock and key are preferred but optional. For example glue may be used, or any other conventional means for securing a joint.<br>Examples: double dovetail (bowtie), I-beam, wedge, dowel, biscuit, screw or nail countersunk in from weatherstrip side, L-bracket for weatherstrip groove, etc. |
| 32 | keyhole at joint 11, for receiving locking key 30<br>examples: double dovetail, I-beam, straight slot for a wedge key, dowel or biscuit holes, screw or nail pilot hole from weatherstrip side, extra depth in weatherstrip slot for L-bracket, etc. |
| 38 | rabbet on frame piece back side 10b that extends the length KHd from the keder slot to the glazing side 10g of frame |
| Rd | Rd = Rabbet depth = enough to accommodate a rigid glazing sheet adhered to the rabbet face (e.g., about 3/16"). This also allows the glazing sheet 22 to extend from approximate center of the keder channel 12, thereby minimizing torque on frame piece due to tension of the glazing sheet. |
| 42 | back fin of weatherstrip (closest to frame back side 10b), curves toward frame front side 10f |
| Ft | Ft = fin average thickness~1/16" |
| 44 | front fin of weatherstrip, slight curve frontward, wide tip for sealing flat against window opening side walls 202 |
| 90 | insulating window panel in kit form for shipping (custom made, but not fully assembled). Weatherstripped frame pieces 21 are bundled with the kedered glazing sheet 29 for packing and shipping in a compact linear form (along with keys and/or other small items, e.g., glue, a cleaning cloth.) |
| 100, 100' | complete insulating window panel (custom prefabricated and on-site assembled and installed)<br>RELATED TERMS (Illustrated in FIGS. 10A-10B) |
| 198 | existing, built-in, or permanent window, generally having a custom size (dimensions). The user orders a custom insulating window panel for one or more of such existing windows. |
| 200 | window recess/opening in wall surrounding an existing, built-in window. Has a depth Dr which, for best sealing, should at least equal the thickness Tw of the outer (peripheral) weatherstrip edges of the window panel - preferably about a ½ inch minimum. |
| 202 | perpendicular side walls defining the window opening/recess 200 |
| 202a, b, c, d | top, bottom, left, and right side walls, respectively. |
| 300 | example of a shipping box |
| H × W | height and width dimensions representing a custom window size (window opening) = important characterizing dimensions between opposed side walls 202 of the window recess 200. According to an embodiment, a single representative dimension value is determined by selecting the largest one of three spaced-apart measurements (Hi, Wi) of each dimension.<br>A typical existing window 198 is rectangular, and has top and bottom recess side walls 202a, 202b defining a vertical window opening height H, and left/right side walls 202c, 202d defining a horizontal window opening width W.<br>A non-rectangular window opening is accommodated by adapting the definition of custom size H × W to comprise a set of dimensions suitable for characterizing the shape and size of the non-rectangular custom window opening 200. |
| Hi, Wi | Individual values of multiple measurements of H and W, the values being used to determine a custom window size H × W that is representative of a specific window opening. Preferably the measurements are spaced apart along the length of each straight side, e.g., window heights H1, H2, H3 measured at the left end, middle, and right end, respectively, of the top/bottom recess side walls 202a, 202b. Measurements are preferably made by user/purchaser/installer of panels. |

Embodiments of the invention will now be described along with methods for making or providing it. Example part dimensions may be cited according to preferred embodiment(s) suitable for typical residential windows. The exemplary dimensions may be most useful when considered in relationship to each other. Unless specifically stated otherwise the dimensional values should not be considered scope limiting.

As shown in FIGS. 1 and 8 (first embodiment), and 15 and 17 (second embodiment) there are relatively few component elements in the disclosed insulating window panel 100: i.e., frame pieces 10, a flexible glazing sheet 22, and a keder core 28. Preferably, perimeter weatherstripping 20, and joint locking means 30, 32 are included.

According to the method of the invention, these parts are custom prefabricated as custom dimensioned frame pieces 10 (preferably weatherstripped frame pieces 21) and a kedered glazing sheet 29, all configured to form a window panel 100 customized to sealingly and removably fit in a specific window opening 200 as described by the end user, who measures the opening, orders the custom window panel, receives, assembles and installs it. The prefabricated components are packaged for shipment as an unassembled kit 90 that the user assembles and installs.

It will be seen from the disclosed embodiments that the invention includes in its scope different-appearing embodiments of components that are configured differently while still applying the same inventive concept(s). For example, frame pieces that can be assembled to surround and hold a kedered glazing sheet can have different overall shapes and different types of interconnection joints to accommodate interior versus exterior application, larger versus smaller window openings, decorative versus simple appearance, and the like.

The window panel components are designed to enable simple cost efficient customized prefabrication. They can be stocked in quantity at a centralized manufacturing facility for efficiency of scale and benefit of location choice according to cost and convenience factors such as labor, location, materials supply, shipping, etc. Stock rolls of glazing sheet material 22 and keder core 28 are selected according to the invention from among commercially available off the shelf items that can be purchased in small to large quantities as needed. Framing and weatherstripping used to prefabricate custom frame pieces 10 and weatherstrips 20 are novel made-to-order items having shape, dimensions and material determined according to the invention disclosed herein, but they can be stocked in convenient quantities, such as long rolls of weatherstripping and long sticks of framing. For example, the weatherstripping stock can be extruded by a supplier using dies custom made according to specification; and the framing can be fashioned according to the invention from long sticks of wood either in-house or at a contract woodworking facility. Thus the centralized facility for custom prefabricated window making can be a simple mass production operation only needing to do the custom sizing operations of cutting stock materials to custom lengths, forming a keder around the edges of the custom cut glazing sheet material, and packaging window kits for shipping. Application of the weatherstripping stock to the framing stock, preferably done before cutting to length, can be done offsite or in house as part of the final customizing operations.

The method described herein is an embodiment that is "preferred" because it is generally the most economical for "users" who are persons desiring a relatively small quantity of custom-made insulating window panels 100 for their residence. In this method the user provides measurements of specific window openings 200 to the prefabricator, receives corresponding custom prefabricated panel kits 90 that have been inexpensively shipped to the user in compact containers 300, and then performs the final assembly steps so that they can be press-fit installed in the corresponding window openings 200.

It is within the scope of the invention to have "middle men" relieve the user of any or all of their task steps including measurement, order placement, shipment receiving, final assembly, and/or installation. Although provision of such services will obviously increase the user's cost, there will still remain significant savings due to the steps of custom prefabricating at an arbitrarily remote location and of delivering the unassembled panels 90 as packages that are much less expensive to ship or mail than large rectangular panels of the same size but assembled before packaging and shipping. Additional cost savings may accrue due to, for example, a smaller quantity of packing material, and less danger of damage in shipment (such as puncture, collapsing, twisting, etc. of the shipping box).

For example consider shipment of a 3'1"×4'11" insulating window panel. For a prior art prefabricated window panel (i.e., made offsite as a finished, fully assembled item), it would require corrugated cardboard stock to be custom cut to a roughly 6.5' by 5.5' piece that is further cut to form flaps and such, folded, and assembled into a custom sized rectangular carton, and foam or bubble wrap may also be needed to prevent damage. This shipping container would likely at least double the weight of the panel, and its awkward size would require special handling.

However, as illustrated in FIGS. 9A-B; if the same size custom prefabricated window panel 100 is shipped according to the invention in unassembled form (kit 90), then a simple, relatively narrow elongated box 300 could be used, likely selected from a stock of pre-formed standard length boxes—in this case between 5'3" and, say, 6' length. Only a single cross section box size is needed for all panels 100 made from the same framing stock because the custom panel size is achieved entirely by cutting the frame pieces 10 to custom lengths (and correspondingly forming the kedered glazing sheet 29). The panel in kit form 90 can be compactly packaged, for example, by wrapping the custom made kedered sheet 29 around the weatherstripped frame pieces 21. Using frame pieces 10 that are roughly 1.5"×¾" then the weatherstripped frame pieces 21 will be about 2"×¾", so they can be bundled into a roughly 2.5"×3.5", or 2.75"×3.25" cross sectional area (which includes 0.5" for two keder bead diameters Db added by spiral wrapping the kedered sheet 29 around the weatherstripped frame pieces 21. Suitable boxes include rectangular, triangular, and circular/tubular types selected according to conventional knowledge about factors such as strength, resistance to damage, materials cost/availability, and shipping requirements.

Summary of Important Aspects

The insulating window panel 100 is specifically designed to reduce costs even though each panel may be a different custom size. They can be prefabricated at any location to custom size in a kit form 90 that is easily shipped in a significantly compacted form to an end user who is arbitrarily remote from the manufacturing/prefabricating facility. Further cost savings accrue from novel design elements that enable an end user of no particular skill or strength to easily assemble the kit 90 into a finished window panel 100, and to install and remove it as desired. Therefor, once an insulating window panel 100 is prefabricated to a user's custom size, it can then be consolidated, packaged, and shipped as a kit 90 in a compact linear form to a destination where it may be assembled easily, and without the use of tools, to the finished shape and size of the window panel 100. This allows for more economical packaging and shipping than other window panel products. Furthermore, the design of the weatherstrip allows for easy installation into a window opening without needing fasteners, and without damage to walls or woodwork. In prototype testing the weatherstripping held the panel in place and prevented air leakage even in a 50 mph "draft", yet it is easily removed by hand.

Component Descriptions

Overview

FIGS. 1-5 illustrate a first embodiment of the main elements and structure of the disclosed window panel 100, and FIGS. 15A-E show a second embodiment of the framing components and structure. The first embodiment is most suited for indoor use, and therefor has decorative aspects on the exposed interior (front) side 10*f* such as a stylish molding shape, and nice finish preferably on a wood surface (e.g., stain and varnish, paint). The second embodiment is more rugged to address the needs for additional strength (such as for large and/or multi-pane window panels), and/or weather resistance and durability when used as an exterior mounted "storm window", and therefor uses stronger reinforced butt joints 11*b* with frame pieces that can be used in a stile-rail-muntin type of window structure. Particularly for outdoor use, the frame pieces may have a more practical (less decorative) rectangular cross-section and are made of weather resistant material such as painted and/or pressure treated wood, or plastic (e.g., extruded) that may have embedded color and/or a textured surface (e.g., simulated wood grain). Although stronger and more durable, the plastic framing material is typically not as stiff as hardwood, therefor the use of muntin and rail crosspieces is particularly suitable for preventing inward bending of long frame pieces under tension of the glazing sheet.

A distinguishing feature is the use of transparent flexible glazing sheet 22 with kedered edges 24, and a frame made of frame pieces 10 having a keder channel 12 to hold the kedered glazing sheet 29 along all sides with uniform tension. Sliding the keder 24 in a channel 12 is a simple matter, with tension not being fully applied until the end of assembly.

Another important feature is the weatherstrip 20 which both seals the window opening 200 and also removably holds the window panel 100 in the opening.

Window Glazing

The window glazing 22 must be flexible to allow compact shipping, but tough enough for multi-year durability rather than one time use, so clear/transparent plastic films were evaluated. In general, as thickness t is increased for a plastic sheet material, the toughness increases while flexibility decreases. Plasticized PVC film was selected because it offers much better overall results than other clear flexible materials. Our preferred form is ultra high quality marine grade transparent PVC with UV stabilizer, and a thickness t between about 8 to 20 mil (0.008"-0.020"). Above about 20 mil the material starts to be unmanageably stiff, not as transparent, difficult to "weld" an overlapped hem, and difficult to fit and slide in a keder channel 12. An available size that works well is 15 or 16 mil thickness t. Rolls of this film are available in widths up to 54" which is adequate for most window opening widths. Muntins or mullions can be used to divide larger spans into multiple panes or windows, a practice that is recommended for overall window strength. Note that pressure on the center of a span of flexible material translates to tension at the sheet edges that is magnified significantly in proportion to the length of the span.

Keder

According to the invention, a keder 24 is formed at the edges of the glazing sheet 22 so that the kedered glazing sheet 29 can be uniformly held by a keder channel 12 in the frame pieces 10. FIG. 4 shows how a self-keder 24 is formed by wrapping the free end 23' at an edge 23 of the glazing sheet 22 around an elongated keder core 28 and the overlapping portion 26 is welded (e.g., using a thermal wedge) to the sheet 22 close to the captured keder core 28 to form a hem along the length of the glazing sheet side. When viewed end-on, the keder cross-section may be referenced as a keder bead 24 with a keder neck 26 (the hem) extending radially outward.

Besides cost, availability and practicality, the keder core 28 diameter is a result of balancing increased holding power of a larger bead 24 diameter Db against decreasing frame 10 strength as diameter Dc of the keder channel 12 is increased to accommodate the larger bead diameter. Furthermore, extra space is needed in the channel 12 so that the keder bead 24 will slide in it easily enough to enable simple, tool-less assembly by typical end users. Additionally, the keder neck thickness (2t) must be balanced against a width Ws of a keder slot 15 where the keder neck exits the keder channel 12; wherein increased slot width Ws allows easier sliding of the neck 26 along it, but simultaneously decreases holding power for a given bead diameter Db (which equals 2t plus the core diameter). FIG. 3 illustrates the holding edges 15*a* and 15*b* where the keder slot 15 intersects the keder channel 12. Considering all these factors, and experimentally testing variations, a best mode embodiment according to the invention has nominal dimensions approximately as follows: a keder core 28 with diameter 0.19" wrapped in glazing sheet 22 having a thickness t of 16 mil (0.016") to form a keder (bead) diameter Db of 0.22" and a keder neck 26 thickness of 32 mil (0.032"). The corresponding keder channel diameter Dc is about ¼" (0.25)" and the keder slot width Ws, about ⅛" (0.13").

Weatherstrip

The weatherstrip 20 is a flexible compression gasket specially designed for two purposes: it both seals the window opening 200, and also serves as a self adjusting means of removably holding the window panel 100 in the overall center of the opening.

The weatherstrip 20 is attached along the entire perimeter of the assembled window frame 10, and is joined at each frame corner such that it fills the corners of the window opening 200 (e.g., using a mitered joint 11*a*). It is attached without the need for adhesive by a protruding barb 16 that is press fit into a weatherstrip receiving groove 18 along a weatherstrip side/edge 10*w* of perimeter frame pieces 10, 10', 10'''. The groove is, for example, about ⅛" wide×¼" deep. The barb 16, which may include a base portion of weatherstrip fins 42, 44, preferably has holding ridges making the barb 16 slightly wider than the weatherstrip groove 18. The base portion lies across the frame weatherstrip edge 10*w* to separate the fins 42, 44. The base is about 1/16" thick by about a ½" across.

At least one, preferably two thin flexible fins 42, 44 extend laterally outward to a width Lw (e.g., about ½") away from the frame weatherstrip side 10*w*, the fins having an average thickness Ft that is, for example, approximately 1/16". The back fin 42 (closest to frame back side 10*b*), has a concave-frontward, rounded shape that curves toward the frame front side 10*f* to facilitate insertion into, and alignment with, the window opening 200, while also resisting panel movement out of the window opening 200. The front fin 44 has a slight curve frontward, and a wide flared outer tip for sealing flat against window opening side walls 202, thereby sealing irregular surfaces such as screw or nail heads and nicks in the sidewall surface.

The fins 42, 44 are made of a soft, relatively low Durometer, resilient material (e.g., closed cell EPDM rubber), for example being a "medium" grade softness of 2A3 according to the ASTM D1056 scale. This low Durometer material, especially on dual fins, provides a good amount of friction while still retaining shape and surface finish; and combined with the frontward curve of the fins allow both for ease of installation, and resistance to the panel falling or blowing out of the window opening.

In an embodiment shown in FIG. 1, the entire weatherstrip 20 (barb 16 plus fins 42, 44) is made from a single material as described above. In another embodiment (shown in FIG. 2) that may be easier to insert into the groove 18, an alternative weatherstrip 20' is made from two different Durometer materials (soft for fins 42, 44, and relatively stiff for base/barb 16'), made for example by co-extrusion. The stiffer barb 16' material may be, for example, dense EPDM with a 75 Durometer hardness on the ASTM D2000 scale.

As a result of this design, the insulating window panel 100 pushes into a window opening 200 with very little effort or resistance, and grips the recess sidewalls 202 securely, without the need for any type of fasteners. Furthermore, it is easily removed by pulling a side of the panel outward, causing the weatherstrip fins 42, 44 to flex backward, "doubling back" on themselves. This is a unique design advantage over the round bulb type seal found in other prior art storm window products.

Frame

Typical frame pieces 10 (see first embodiment in FIGS. 1, 3, 5 and 8) are the same shape except for length, have mitered end joints 11*a*, and form a perimeter frame around a kedered glazing sheet 29 when assembled.

Rugged/exterior frame pieces 10 (see second embodiment in FIGS. 15A-E, 16, and 17) are distinguished by the use of reinforced butt joints 11*b*, plus changes to the location of the keder channel 12 to accommodate the joints 11.

Nevertheless, both frame embodiments utilize substantially the same inventive features and methods.

First Embodiment, Frame with Mitered End Joints

The mitered frame pieces 10 have a front side 10*f*, preferably decoratively shaped, and an opposed back side 10*b* which doesn't have to be decorative because it is intended for placement against the existing window 198. Likewise opposed are an outward facing weatherstrip side 10*w* and a glazing side 10*g* that faces inward along the window glazing 22 which emanates from the glazing side 10*g* of an assembled window panel 100. The frame shapes are designed to enhance the appearance, especially when compared with the square aluminum or vinyl storm window frames of the prior art. Additionally, the rounded ogee shape adds thickness in the middle of the frame to offer strength and resistance to twisting and bowing while eliminating unnecessary bulk and allowing the framed window panel 100 to slip easily behind existing window treatments and trim and recess depths as little as about ½".

Along the weatherstrip side 10*w* the frame 10 has a weatherstrip groove 18 shaped for holding without adhesive a barb 16 portion of a resilient weatherstrip 20.

The keder channel 12 is cut from the back side 10*b*, for example using a ball mill to create a longitudinally extending round/cylindrical channel with diameter Dc of about ¼", sized to hold a round keder bead 24, and a keder slot 15 to provide a radially extending channel opening through which the keder neck/hem 26 and continuing glazing sheet 22 extend. For example the keder slot may be at an angle A of about 45° to the frame back side 10*b*.

A rabbet 38 is cut on the frame piece back side 10*b* that extends the length KHd from the keder slot 15 to the glazing side 10*g* of the frame. The rabbet depth Rd (e.g., about 3/16") is not quite down to the center of the keder channel 12, thereby allowing the glazing sheet 22 to extend from close to the center of the keder channel 12, thereby minimizing torque on the frame piece 10 due to tension of the glazing sheet 22 after window assembly. The main reason for the rabbet 38 is to facilitate rotation of the frame piece 10 on the sheet edge keder 24 during window assembly. As will become clear given the description hereinbelow, the final frame piece 10 to be assembled must be rotated so that the glazing sheet 22 extends roughly perpendicularly out of the frame back side 10*b* while the keder 24 is sliding into the keder channel 12, after which the final frame piece 10 is then rotated until the glazing sheet 22 extends out of the frame glazing side 10*g* in line with the surface of the glazing sheet 22 throughout the glazed area. This makes it possible to slide the last frame piece into position without being affected by tension from the glazing sheet, because the tension is applied as the piece is rotated while sliding the mitered joint faces into alignment at the corners. The miter angle functions as a wedge forcing the rotating piece away from the glazed area while simultaneously forcing the two side frame pieces apart, thereby simultaneously tensioning the glazing sheet both horizontally and vertically to make it uniformly taut without wrinkles, and the amount of tension has been predetermined by the relationship between kedered sheet dimensions and dimensions of the keder channel in the assembled frame. An optional benefit of the rabbet 38 accrues if the rabbet depth Rd is enough to accommodate a user-provided rigid glazing sheet that a user might want to adhere to the rabbet face, thereby making the rigid glazing recessed from the frame back side 10*b*. For example, a rabbet depth Rd=3/16" would accommodate a commonly used rigid glazing sheet such as ⅛" PMMA plastic.

Position of the Keder Channel Within the Frame Piece

Relative to the cross-section of the frame piece 10, the keder channel 12 is located in a side to side position that enables the frame to cover and seal against the glazing sheet 22 surrounding a corner cut 25, and to conceal the keder hem 26 behind the frame, while allowing room for the weatherstrip groove 18 and key hole 32 on the other side of it, all without weakening the frame 10. With a 1.5" wide frame piece 10, the channel 12 can be positioned near the center of the width. In an embodiment, for example, an 11/16" keder offset Ko is the widthwise distance that channel 12 (having a width/diameter Dc of ¼") is offset from the frame weatherstrip side 10*w*, and a 9/16" keder hem depth KHd is the widthwise distance from the keder channel 12 to the frame glazing side 10*g*.

The channel 12 is located in a front to back depthwise position sufficient to allow the desired rabbet depth Rd but still as near as practical to the frame back side 10*b* to allow for as thin a frame as possible (e.g., ¾"), which maximizes installation possibilities.

The decorative ogee molding face allows the frame to reach full dimension near the middle for strength and resistance to bowing and twisting; but then returns to a ½" thick (Tw) weatherstrip edge so that it can be installed in a recess 202 as shallow as a half inch, again maximizing installation possibilities.

Second Embodiment, Frame with Reinforced Butt Joints

A second insulating window panel embodiment 100' was designed with outdoor use in mind, but it can also be used anywhere a more rugged/strong window panel is desired, for example where the total area of the window opening 200 is so large that it is best to divide it into a plurality of smaller glazing areas, each covered by a kedered glazing sheet 29 held on all sides by a keder channel 12 in a frame piece 10. To do this, there must be muntin bar type of framing crosspieces as dividers, and these are more easily implemented with some kind of butt joint wherever the end of a muntin bar joins to a side of a frame piece.

Regardless of appearance and type of joints, the rugged/exterior insulating window panel 100' is still based on at least two of the same distinguishing features that the interior (mitered frame) insulating window panel 100 is based on: the flexible film with a keder attachment to surrounding frame pieces, and the finned weatherstrip/attachment seal. Also the method of providing a custom size insulating window panel has essentially the same steps, although user assembly method is slightly different but no more difficult. Both the frame materials and their dimensions may be different than the interior product, and while the interior frame piece 10 rotates on the film keder 24 to facilitate assembly of the mitered corner joint 11*a*, the exterior product frame pieces 10', 10", 10'" use a butt joint 11*b* that is configured to be assembled between two frame pieces and then slid into the intended joint location, as further detailed hereinbelow. In both cases the full tensioning of the glazing sheet 22 is accomplished at the end of the assembly process.

Particularly as shown in FIGS. 15A-E, 16 and 17, the reinforced butt joint frame pieces 10 are in three different standard forms according to their function in creating a multi-pane insulating window panel 100' such as the one shown in FIG. 17 as a kit 90 laid out for assembly. There are stile frame pieces 10' (FIGS. 15A-B), and rail frame pieces 10'" (FIGS. 15A, C and D) that are assembled to form a weatherstripped perimeter frame, therefor they both have a longitudinal glazing side 10*g* and an opposed longitudinal weatherstrip side 10*w* that has a lengthwise weatherstrip receiving groove 18. The glazing side 10*g* of at least the stile piece 10' has a keder channel 12 with a keder slot 15 leading out toward the glazing side 10*g* through a butt joint groove 14, which is the "female" tongue-receiving part of a tongue and groove version of a reinforced butt joint 11*b*. The channel 12, slot 15, and groove 14 extend in parallel along the length of the glazing side 10*g*, as best seen in the stile cross-sectional view of FIG. 15A in conjunction with the corresponding end view of FIG. 15B. Obviously the rail frame piece 10'" also needs the keder channel 12 and keder slot 15 along its glazing side 10*g* for holding a glazing sheet kedered edge 24, but as will be seen hereinbelow it preferably also has a butt joint groove 14 in the same arrangement as in the stile frame piece 10'. This is best seen in the end view of FIG. 15D.

The third form of a rugged frame piece is a muntin bar frame piece 10" (FIG. 15E) which is for optional use between any of the rugged frame pieces 10', 10", 10'" to divide the glazing area vertically, horizontally or both, into two or more smaller panes, each with its own kedered glazing sheet 29 that is held in a surrounding keder channel 12 in adjoining frame pieces 10', 10" and 10'". FIG. 17 shows an example of a long rectangular window panel kit 90 that uses a muntin bar frame piece 10" across the middle to make a two pane window panel 100'. The muntin piece 10" is thus a framing crosspiece between two kedered glazing sheets 29, so it has two glazing sides 10*g* and no weatherstrip side 10*w*. The glazing sides 10*g* are preferably configured the same as the other glazing sides, i.e., including a longitudinal butt joint groove 14 along with the keder channel 12 and keder slot 15 that are used for holding a kedered glazing sheet edge (bead 24). This enables a first muntin bar frame piece 10" to be joined with a perpendicular second muntin frame piece 10" using the same reinforced butt joint 11*b* as used on the glazing side of the stile frame piece 10'. It may be noted that the glazing side 10*g* of the rail frame pieces 10'" preferably also has the butt joint groove 14 so that a perpendicular muntin bar frame piece 10" can be joined to its glazing side 10*g* the same as with the muntin frame piece 10".

Both the rail 10'" and the muntin 10" frame pieces have joint ends, preferably configured as a "male" butt joint tongue 13 that mates with the tongue receiving butt joint groove 14 to form a tongue and groove type of reinforced butt joint 11*b*. The butt joint groove 14 has a depth TL that is matched with a tongue length TL. Likewise, Wt represents matched tongue thickness and nominal width of the mating groove 14.

Although described as a tongue and groove embodiment, it should be apparent that the term "reinforced butt joint" 11*b* includes in its scope many other forms of a joint between a frame piece end and a side, wherein the frame pieces 10', 10" and 10'" can be adapted to utilize the joint in similar fashion. For example, some other examples of a reinforced butt joint 11*b* may include: mortise/tenon, dowel/hole, biscuit/pocket, and so on. For example, a nail or screw 30 in a pilot hole 32 could be used to reinforce a butt joint without a tongue or groove. (However, when combined with an otherwise reinforced butt joint as shown in FIG. 15A, the nail or screw may be considered a form of joint locking key 30 in a keyhole 32).

Because the reinforced butt joint 11*b* is defined as being located on the glazing side 10*g* of the stile frame pieces 10' and not on its ends, the stile piece ends have a weatherstrip groove 18.

The embodiment illustrated in FIG. 17 shows a large two-pane insulating window panel kit 90 made with frame pieces 10', 10" 10'" that utilize tongue and groove joints 11*b*. Not only is it bigger, but the frame elements 10 are constructed for rugged use such as an exterior storm window 100, where resistance to wind and water (in any form) is more important than a decorative shape. Thus the rugged/exterior frame pieces 10', 10", 10'" have a simple rectangular cross-section shape (e.g., about ¾" by 2"), use reinforced butt joints 11*b*, and use muntin bars to avoid weaker large glazing areas. Preferably the frame pieces are made of weather resistant material such as plastic, for example. Because of symmetry, the rugged frame pieces may have indistinguishable "front" 10*f* and "back" 10*b* sides, unless only one side of a frame piece is given a more appealing surface texture or whatever. Of course, once a frame piece is weatherstripped 21 then the frontward curvature of the weatherstrip fin(s) 42, 44 will define the back versus front sides, as shown for the two weatherstripped stile frame pieces in FIG. 17.

Joint Locking

Once the insulating window panel 100 is assembled it is generally preferable to lock the frame joints 11 to prevent relative movement of the frame pieces 10. In preferred embodiments the panel 100 utilizes some form of joint lock comprising a locking key 30 that bridges and stabilizes/secures a frame joint 11 when fit into a mating keyhole 32. Both lock and key are preferred but optional. For example glue may be used by itself, or any other conventional means for securing a joint may be adapted for use as a locking key 30 and/or keyhole 32.

Locking key 30 and keyhole 32 examples may include, without limit, a double dovetail (bowtie) key in a correspondingly shaped two part keyhole as illustrated in FIG. 5; an I-beam equivalent of the double dovetail; a wedge pressed into a straight slot; an L-bracket affixed in the weatherstrip groove on both sides of a miter joint, a flat plate affixed on the frame back sides 10*b*; and a screw or nail in a pilot hole (preferably countersunk in the frame weatherstrip side 10*w*, more preferably hidden in the weatherstrip groove 18 as shown in FIG. 15A). For example, a dowel or biscuit could be used in mating dowel or biscuit holes. Obviously this is not an exhaustive list.

Optional Elements or Alternatives

Insect screening material, tinted film, decorative sheet, photovoltaic material, light filtering, or other materials may be used as the window glazing sheet material 22, to accomplish a wide variety of functional and decorative purposes.

For large window openings, instead of using muntin bar frame pieces 10" to create a multi-pane window opening cover, the weatherstrip 20 can be adapted so that independent adjacent panels can be combined. For example, the fins 42, 44 of adjacent weatherstrips 20 could simply be interleaved; or one of the adjacent weatherstrips 20 could be omitted, and a fin 42 or 44 from the remaining weatherstrip could be pressed into the other frame piece's weatherstrip groove 18. A better appearance might be had by creating a double barbed connecter (a mulling spline) that could be inserted into both adjacent weatherstrip grooves 18.

Method of Providing the Insulating Window Panel

According to the present invention, a method is disclosed of providing a custom size insulating window panel 100 for removable installation by a user in a custom size window opening 200 around a built-in window 198, wherein the window opening 200 comprises a recess 202 defined by perpendicular side walls surrounding it. As described hereinabove, this method includes inventive concepts, and is enabled by the inventive components which are all designed to achieve the objectives of reducing the cost of good quality insulating window panels primarily for a non-commercial end user who wants to reduce heat transfer through one or more specific existing windows 198 in their place of residence. Windows like this are rarely all a uniform or standardized size, and furthermore may have dimensions that changed since house construction due to structural shifts, for example. Thus the user typically needs window panels in a variety of sizes that are unique for them, i.e., custom sized.

In the past, the only way for an unskilled user to obtain good quality, effectively insulating window panels has been to hire a contractor to make custom window panels from scratch, or at least by on-site customizing of standard window components, or to install a completely new replacement window that includes two or more insulating layers of glass. In the latter case, the window opening usually needs to be modified to fit a standard size replacement window, or else a local "window factory" will customize standard components to manufacture a full size replacement window that can be trucked to the user site for professional installation.

The inventive method avoids much of this cost by eliminating middle men and local facilities. Approximate measurements of the custom window opening made by the user are accommodated by the use of a weatherstrip that will adapt to the opening while still sealing. The windows can be custom prefabricated at a centralized, remote manufacturing facility because the use of flexible window glazing 22 enables economical shipping as an unassembled kit 90 in a compact form; and also because the users themselves can assemble and install the insulating window panel 100 due to the simplicity inherent in our novel design: wherein assembly comprises sliding kedered edges 24 of prefabricated-to-size kedered glazing sheet 29 into keder channels 12 in prefabricated-to-size frame pieces 10.

With reference to FIGS. 6-17, the method is now described in more detail. As elsewhere in this disclosure, except where needed for clarity, any mention of a reference number should be assumed to include variants with primes added to the reference number. For example, weatherstrip 20 is inclusive of weatherstrip 20'. Furthermore, the use of letters after a reference number should be understood according to context. The reference number key should also be consulted in case of confusion.

FIG. 10A shows an example custom sized existing window 198 having a window recess 202 that defines the custom size window opening 200, within which the finished panel 100 is to sealingly and removably fit. FIG. 10B shows just the window opening 200 which has somewhat irregular recess sidewalls 202 (designated 202*a* and 202*b* for top and bottom ends that determine opening height H; and 202*c* and 202*d* for left and right sides that determine opening width W).

According to the method, window dimension variations due to physical irregularities and/or due to inaccuracy of user measurement are accommodated by having the user determine a custom window size H×W by making a plurality, e.g., three, spaced apart measurements Hi and Wi of window recess dimensions between opposed side walls as shown in FIG. 10B.

The user orders the custom insulating window panel 100 for this particular window 198 by listing the three Hi and three Wi measurements along with a name they choose to identify the particular window 198.

Then the offsite manufacturer prefabricates panel components for the user to assemble and install (using manufacturing stock as described hereinabove). Referring particularly to FIGS. 6-8, the prefabrication steps are described for a single pane embodiment of an insulating window panel 100. It should be noted that this is representative of all insulating window panels 100 according to the present disclosure. Thus, given the teachings herein, it should be apparent to one of ordinary skill in the related arts how to adapt and apply these teachings regardless of the number of panes 29 and type of frame pieces (e.g., 10, 10', 10", 10''') being used.

A hypothetical "template", best seen in FIG. 6, comprising lines on a work surface is used to explain the process. Obviously, such a flat template is not the most accurate or effective way to carry out the process, especially because template overall dimensions must be changed for use with every custom sized window panel. In fact custom production tables were developed to perform this process, as nothing like it was commercially available. Thus the template lines are actually implemented as stop plates, clamps, and tool guides as appropriate, and with scales and adjustment screws on movable stops for adjusting spacing and positions relative to a specified custom window opening with dimensions H×W.

FIG. 7 shows the same template with finished prefabricated parts laid on it, i.e., a kedered glazing sheet 29 and weatherstripped frame pieces 21. The joint 11 is left unclosed to make lines visible. A custom window opening width W and height H is indicated on the template by a circumferential boundary line M2. The weatherstripped frame pieces 21 are bounded by line M1, the weatherstrip edge 10*w* of the frame pieces 10 is at line M6, and the kedered glazing sheet 29 has a height and width demarked by lines M4 (which is interrupted at its corners).

Every template line is related in a predetermined manner to the specified custom window opening dimensions H×W. Since the relative dimensions are fixed (the distances between template lines), then adjusting the template for any custom window opening size is easily accomplished, for example, by leaving the template's upper left corner fixed on the table as shown in FIG. 6, and moving a lower right template corner (a rotated equivalent of the upper left corner) downward and to the right until the M2 circumferential line has a vertical dimension equal to the custom height H, and a horizontal dimension equal to the custom width W. Then the weather-stripped frame pieces 21 can be cut to lengths bounded by the lines M1 and M6, and the glazing sheet 22 can be cut and kedered at the edges to form a kedered glazing sheet 29 that fits in outline M4 (and M5 as will be described hereinbelow). In another example, a full size template like FIG. 6 could be used just for cutting and forming the kedered glazing sheet 29, and the frame pieces 10 (with or without a pre-applied weatherstrip 20) could be measured and cut one or two at a time in a linear jig that has the fixed distance between lines M6 and M2 built in to the length measuring scales. For example, if the distance is 7/16" then the frame piece length along the weatherstrip side 10*w* should be H or W minus two times 7/16"=H or W minus 7/8". So the scale of the cutting jig could be calibrated to show a frame piece length between miter cuts of H or W inches, but would actually position the miter saws a distance of H or W minus 7/8" apart at the outside edge 10*w*.

The predetermined template line relationships are:

M2 is the controlling dimension line, so the template is adjusted and locked down such that it matches the custom window opening size H×W as determined from user measurements. All other template lines are pre-positioned and fixed relative to M2.

M1 is located outward of M2 by half of the window margin Wm on each side, thereby outlining overall assembled window panel 100 dimensions of height=H+Wm and width=W+Wm. This corresponds to the panel size before it is press-fit into the window opening 200, thereby compressing the weatherstrip by at least the margin amount Wm at the widest and the highest parts of the window opening 200 as measured. The margin Wm thus provides a tolerance allowance to accommodate potential measurement inaccuracy and also wherever the widest or tallest part of the window opening may not have been measured. Furthermore the margin Wm generally causes the weatherstrip 20 to compress at least slightly even at the maximum opening dimensions to insure sealing contact, and friction for holding the frame 100 in the opening 200.

M6 indicates the perimeter of the assembled frame pieces 10 and is positioned where the frame weatherstrip side 10*w* should be, i.e., inward from M1 by the nominal value of Lw, the weatherstrip lateral extension width (uncompressed). We have determined a preferred value of about 1/2" for Lw.

M4 is the location of the outside edge of the keder bead 24, which is approximately the keder channel offset dimension Ko inward from M6 as is fixed in the frame piece 10 design (see FIGS. 5 and 15B). Since the keder bead diameter Db is somewhat less than the keder channel diameter Dc, and further because the gripping edges 15*a*, 15*b* on either side of the keder slot 15 allow an undersized keder bead 24 to be pulled off-center of the channel 12 by glazing sheet tension, therefor the correct keder bead 24 location is a small but undefined increment inward from M6 minus Ko. Fortunately, that increment is reasonably constant for a given glazing sheet thickness t and keder core diameter KCd, so the correct location for M4 can be found by fine tuning adjustments until a kedered sheet 29 results in a properly tensioned glazing sheet in an assembled test frame. Since the heavy gauge PVC glazing sheet material doesn't stretch much, the tension should be just enough to make it uniformly taut without wrinkles.

M3 marks the edges 23 of the glazing sheet 22 when it is cut to size from the stock sheet material. It is located such that when the cut sheet edges 23 are wrapped around the keder core 28 and hemmed to form a keder bead 24 bounded by line M4, then the cut edge after hemming (labeled 23' in FIG. 6) will have a desired amount of overlap 26. This is probably the least sensitive dimension given its limits: wide enough to form a sufficiently strong welded hem (e.g., about 1/2"), and not so wide that it would be visible in the glazing area, i.e., no more than the keder hem depth KHd (see FIGS. 5 and 15B), which is about 5/8" plus/minus 1/16".

M5 marks the location of corner cuts 25 that space apart two keders 24 where they meet (intersect) at a frame joint 11. The cut 25 is made along line M5 across each corner of the glazing sheet 22 after it has been cut to size along line M3, but before the cut edges 23 are folded/wrapped over the keder cores 28 for hemming. A convenient way to trim the cores 28 may be to have them laid in place (along M4) so that the corner cutting operation trims the excess core length while also cutting the glazing sheet; however the exact shape of the core cutoff is not critical. The maximum keder core length is a result of how the keder channels 12 meet at an assembled joint 11. For a mitered joint 11*a*, the channels form a right angled corner that maintains a constant channel diameter Dc throughout, so there is no space for keders or cores to overlap or go beyond the corner. However, for the reinforced butt joints 11*b*, as shown in FIG. 15A, the keder bead 24 will not fit in the slot 15 so the perpendicular distance between the two beads at the corner must be separated by at least one slot depth Sd.

The corner cut 25 is an important aspect of the inventive design because it enables assembly of the frame pieces 10. In particular, the corner cut 25 creates a corner cut spacing Cs, which is the separation between keders 24, i.e., the perpendicular distance from the side of one keder to the end of the other keder. The "keder end" is defined as the end of the glazing sheet 22 where it is wrapped around the keder core 28. As shown in FIGS. 6, 7, and 15A, the keder end is determined by the sheet edge 25 created by the corner cut on M5, regardless of whether or not the core 28 extends beyond the sheet edge 25. (Excess core can be bent out of the way during assembly because it isn't held by the sheet.)

The corner cut 25 template line M5 is generally positioned to create a corner cut spacing Cs greater than a minimum needed for frame assembly, but not much more, to prevent unacceptable back to front air leakage through the space between keders 24. At the most, the spacing Cs should not exceed two times the keder hem depth KHd because that would put the midpoint of the edge of the corner cut 25 at the intersection of the glazing sides 10*g* of the frame pieces 10 at the joint 11. Beyond that, the cut edge would cross the uncovered glazing area beyond the intersecting glazing sides 10*g* of the frame pieces 10, leaving an open hole through the glazing sheet 22. On the other hand, a small opening that is covered by the keder hem depth portion of the frame pieces is helpful as a restricted vent for equalizing pressure in the weatherstrip-sealed air space between the window 198 and the installed window panel 100. As seen in FIGS. 5, 7 and 15B, for the mitered corner frame pieces, KHd is the width of the rabbet 38, and for the butt joint frame pieces KHd equals the slot depth Sd plus the tongue length TL. The minimum keder separation Cs at the corner cut 25 is the separation needed to enable assembly of the insulating window panel 100.

Assembling the Insulating Window Panel

Assembling the Interior Embodiment

Referring to FIGS. 8 and 11-14, we now describe the on-site assembly of the interior embodiment of insulating window panel 100, more specifically to a window panel 100 having mitered corner joints 11*a*. This will show how the novel elements and features of the panel 100 work together to make this a process simple enough for a typical user of no particular skill or strength to complete without professional assistance.

FIG. 8 shows an example kit 90 laid out on a table or floor by a user who has received it and unpacked it from the shipping/mailing box (e.g., kit 90 in box 300 as shown in FIGS. 9A-9B). There are four weatherstripped frame pieces 21 arranged around a kedered glazing sheet 29, and there is a locking key 30 for the locking keyhole 32 that spans the joint 11 at each of the four mitered corners. The view is of the back side (10*b*) of the frame pieces 10 such that the keder channel 12 can be seen extending along the length of each frame piece and opening out into the parallel longitudinal rabbet 38.

FIG. 11 shows the result of sliding three of the keder edges 24 into the keder channel 12 of the first three weatherstripped frame pieces 21 (i.e., 21*a*, 21*b*, and 21*c*). This is easily done because there is no tension on the glazing sheet 22, and the corner joints 11 are held in place, properly aligned, by the locking keys 30 that are press fit into their key holes 32. Advantageously, the keys 30 make the three sided assembly relatively rigid so as not to twist, roll, or otherwise lose its proper shape.

The fourth and final weatherstripped frame piece 21*d* requires a special orientation so that it can be slid over the frame pieces 21*a* and 21*c* that are in the way because the mitered ends overlap the last keder edge 24. Referring to both FIGS. 11 and 12, we see that the last frame piece is rolled over to be front face 10*f* up to lie on the back side 10*b* of the assembled frame pieces. The corner cuts 25 allow the last keder edge 24 to be lifted up above the assembled frame piece backs by an amount sufficient to insert the keder edge (bead) 24 into the channel 12 of the final frame piece 21*d*. FIG. 11 shows the final piece 21*d* as it is being slid along the keder edge 24 over the back side of piece 21*a* and toward 21*c*. FIG. 12 is a magnified view of the result where piece 21*d* has slid almost all the way over and is lying on piece 21*c*. Here it can be clearly seen that the cut edge 25 of the glazing sheet 22 extends from the top of the lower bead 24 (at the associated holding edge 15*a*) to the bottom of the upper bead 24, which is also at its associated holding edge 15*a*. The slot depth Sd is the distance between the holding edge 15*a* and the back side 10*b* of each frame piece, therefor the distance between the two beads (i.e., the corner cut spacing Cs) must be at least two times the slot depth Sd as shown.

After the final weatherstripped frame piece 21*d* has been slid all the way across, then it can be rotated as shown in two different views of FIGS. 13-14, wherein the glazing edge 10*g* can rotate in the space between the mitered ends of the assembled pieces 21*a* and 21*c* to rise into engagement while the weatherstripped side simultaneously rotates down into engagement of the mitered joint 11 faces. Because of the 45 degree miter angle, the act of pushing the frame together will simultaneously wedge apart all four sides of the frame, thereby uniformly tensioning the kedered glazing sheet 29 both laterally (widthwise) and longitudinally (lengthwise) by the amount predetermined by the dimensions of the custom prefabricated insulating window panel 100.

Assembling the Exterior/Rugged Embodiment

Referring to FIG. 16, a muntin frame piece 10" is shown being slid to the right to be positioned at the middle of the stile frame piece 10' above it. Two kedered glazing sheets 29 are installed in the keder channel 12 on either side of the muntin so they move with it. The adjoining kedered edges 24 are likewise installed in the keder channel 12 of the stile, so they slide within the channel as the muntin is moved. This is easily accomplished in the first stile because the muntin can be separated from the stile for movement. It should be apparent that completing frame assembly by installing opposed keder edges 24 in the channel 12 of an opposed stile 10' may require a bit more effort once the muntin 10" begins to slide along the stile. In order to do so, the tongues 13 at both ends of the muntin 10" must be fully engaged inside the butt joint groove 14 of the corresponding stile 10', and then must slide in the groove to the middle of the second stile 10'. The muntin frame piece 10" (and the rail frame pieces 10'" on either end) are dimensioned to apply at least a small amount of lateral tension to the glazing sheet 22. Once the two rails 10'" are slid into place at the top and bottom ends of the assembled frame, the final tensioning of the glazing sheets 22 is accomplished by locking the rails in place. For example, a first rail 10'" can be locked at one end using, for example a nail, screw or pin 30 installed in a pilot hole 32; and then the opposed second rail 10'" can be similarly locked while being pulled to apply longitudinal tension on both glazing sheets 22. Preferably the intermediate muntin frame piece 10" is not locked so that it can "float" in the middle, thereby equalizing longitudinal tension for the two kedered glazing sheets 29.

CONCLUSION

Thus, a custom prefabricating method embodiment may include the following steps:

a) Referring to FIGS. 10A-10B, define the custom window size dimensions H and W as the maximum one of the height Hi measurements and the maximum one of the width Wi measurements, respectively. For example, let the user's measurements be Width: W1=38¼", W2=38⅛, and W3=38"; and Height: H1=63", H2=63", and H3=63". For the custom window opening size, use the largest measurement values (W=38.25"×H=63.0") to prefabricate the custom size panel 100. A tracking label for this panel could read: "38-¼×63 LIVING RM, WEST LH" (using the maximum W×H, and a location description that is provided by the user).

b) Referring particularly to FIGS. 1, 3, 5, and 15-17, prepare a plurality of longitudinally extending frame pieces 10 configured with joints 11 for interconnecting the frame pieces to form a custom size window frame, and wherein each one of the frame pieces 10 has a longitudinally extending keder channel 12 with a longitudinal keder slot 15 that opens out of a glazing side of each frame piece. This may be done efficiently by stocking long sticks of framing stock that has already been given the overall shape described above (e.g., decorative ogee), and already has a keder channel 12, slot 15, rabbet 38 (if any), butt joint groove 15 (if any), and weatherstrip groove 18 (if any) created by woodworking and/or extrusion. The joints 11, and joint locking means 30, 32 (if any) are created when the frame pieces 10 are cut to the lengths needed for a particular custom size frame. For example, the miter joints 11*a* are cut at both ends of each frame piece 10 and locking keyholes 32 can then be cut using an appropriate cutting tool. For rail 10''' and muntin 10'' frame pieces the butt joint 11*b* reinforcement (e.g., tongue 13) is also shaped at both ends of those frame pieces when they are cut to the lengths required for the custom window panel dimensions. Also, stile frame pieces 10' need to have a weatherstrip groove 18 cut into both ends after the pieces are cut to required lengths.

c) Additionally referring to FIG. 2, form a compressible resilient weatherstrip 20 that extends laterally outward to a width Lw from a weatherstrip side 10*w* of frame pieces 10, 10', 10''' that form a perimeter of the window panel, the weatherstrip 20 comprising a longitudinal fin 42 that curves toward a front side 10*f* of the frame pieces as it extends laterally, the frame front side being the side that faces away from the built in window 198 when the panel 100 is installed. Preferably a second longitudinal fin 44 is included, as further described hereinabove. The weatherstrip 20 material can be stocked as long rolls of extruded material. Preferably the weatherstrip 20 is installed in the weatherstrip groove 18 along the length of the mitered frame piece 10 before cutting the end joints 11*a*, so that a straight miter cut can be made across both the frame piece 10 and weatherstrip 20, thereby assuring that the weatherstrip corners will fill the window opening 200 corners without a gap, to seal the opening as intended. Other than at the maximum window opening dimensions, everywhere else in the opening 200 the dimensions should be less, and the weatherstrip 20 has plenty of compression space to handle this. For example, in an embodiment, the weatherstrip lateral extension width Lw is about ½ inch; the weatherstrip base thickness Bt is about 1/16"; the weatherstrip fin thickness Ft averages about 1/16 inch; and the weatherstrip margin Wm is about ⅛ inch. This means that the uncompressed weatherstrips 20 add 2Lw (about 1") to the frame height and width (at lines M6), but the weatherstrip margin takes away Wm=⅛" so the maximum window opening will be ⅞" greater than the frame dimensions. If fully compressed the weatherstrip 20 will have a fin 42 laid over on top of the base 16 to add two times (Bt+Ft) which is about ¼". Therefor the tolerance for variation between max and min window openings is ⅞" minus ⅜" or about ⅝" if we use a weatherstrip margin Wm of ⅛", which is one quarter of one weatherstrip extension width Lw. It also means that a weatherstrip margin Wm of ¼" would leave only ½" of tolerance, and so on to a maximum weatherstrip margin Wm of ¾" (i.e., 1.5 times Lw) which would not leave any tolerance to accommodate window opening dimensions less than the maximum dimension that was mentioned. This is why, with a weatherstrip 20 as described, a weatherstrip margin Wm of 1/16" to 3/16" is preferred, and about ⅛" is most preferred (i.e., 0.25 times Lw). To date our experience has confirmed our preferences.

d) Cut out a flexible glazing sheet 22 having a plurality of sheet edges 23 corresponding to the plurality of frame pieces 10 surrounding a pane of the glazing sheet 22, and dimensioned according to a predetermined relationship with the custom window size dimensions, as detailed hereinabove.

e) Make a kedered glazing sheet 29 (a window pane) by forming a kedered edge bead 24 on each of the cut glazing sheet 22 edges, and by making corner cuts 25 that space apart (Cs) ends of intersecting keder beads 24, all being shaped and sized for sliding each keder edge bead 24 in the keder channel 12 of each corresponding frame piece 10 such that the frame pieces form joints 11 at the intersecting keder edges, and when fully assembled as a window frame, the frame pieces 10 are pulled together at the joints 11 by tension relative to the glazing sheet 22.

f) Configure the frame pieces 10 such that, when assembled, the window frame 10 with a perimeter weatherstrip 20 has outside panel dimensions that exceed the custom window size H×W by a weatherstrip margin Wm that is no more than 1.5(Lw).

g) Finally, bundle the weatherstripped frame pieces 21 and the kedered glazing sheet 29 for packing and shipping in a compact linear form (e.g., as shown in FIGS. 9A-9B). Optionally, the weatherstripped frame pieces 21 can be bundled and shipped with at least some of the weatherstrips 20 being separated from their corresponding frame pieces 10. For example, this may be necessary for the ends of stile frame pieces 10' where the weatherstrip 20 spans the butt joint 11*b* with a rail frame piece 10'''.

The custom prefabricating method thus provides on-site a custom size insulating window panel as a kit 90 that enables the user to complete the window provision process with:

h) simple on-site assembly of the custom insulating window panel 100 by sliding keder edges 24 of the kedered glazing sheet 29 into keder channels 12 of the weatherstripped frame pieces 10, and by pulling the glazing sheet 22 taut when aligning the frame pieces 10 at the joints 11; and i) removable installation over the custom size built-in window 198 by pressing the assembled insulating window panel 100 into the window opening recess 200 where it is removably held due to friction from the perimeter weatherstrip 20 that is compressed by at least the weatherstrip margin Wm within the recess walls 202.

Examples

In a specific example where the frame piece end joints 11 are mitered:

- the back side 10*b* of the frame has a rabbet of depth Rd extending from the keder channel 12 to the glazing side 10*g* of the frame pieces 10, thereby allowing the glazing sheet 22 to extend out of the back side 10*b* during frame assembly;
- the corner cut keder spacing Cs is no less than about twice the slot depth Sd, e.g., at least two times 1/16 inch;
- the weatherstrip extension width Lw is about ½ inch;
- the weatherstrip fin thickness Ft averages about 1/16 inch;
- the weatherstrip margin Wm is about ⅛ inch; and
- a joint lock 30, 32 is applied during assembly to hold frame joints 11 in alignment.

In a specific example where the frame piece joints 11 are reinforced butt joints:

- the keder slot 15 opens out through a butt joint receiving groove 14 that extends in parallel with the keder channel 12 and keder slot 15 along the length of the glazing side 10*g* of the frame pieces 10;
- the corner cut keder spacing Cs is no less than the slot depth Sd, e.g., at least 1/16 inch; and
- the weatherstrip 20 and joint locking characteristics are substantially the same as for the mitered joint embodiment.

Although the invention has been illustrated and described in detail in the drawings and foregoing description, the same is to be considered as illustrative and not restrictive in character—it being understood that the embodiments shown and described have been selected as representative examples including presently preferred embodiments plus others indicative of the nature of changes and modifications that come within the spirit of the invention(s) being disclosed and within the scope of invention(s) as claimed in this and any other applications that incorporate relevant portions of the present disclosure for support of those claims. Undoubtedly, other "variations" based on the teachings set forth herein will occur to one having ordinary skill in the art to which the present invention most nearly pertains, and such variations are intended to be within the scope of the present disclosure and of any claims to invention supported by said disclosure.

What is claimed is:

1. An insulating window panel for simple assembly and removable installation by a user into a window recess comprising perpendicular side walls surrounding a window built into a wall to form a window opening, the insulating window panel comprising:

a plurality of longitudinally extending frame pieces configured with joints for interconnecting the frame pieces as a frame around a window pane of an assembled window panel, wherein each one of the plurality of frame pieces is integral with a fixed longitudinally extending keder channel with a keder slot that opens out to an inside peripheral glazing side of each frame piece; and the window pane comprising a flexible glazing sheet provided with a plurality of edges corresponding to the plurality of frame pieces assembled therearound, wherein a keder is formed on each one of the plurality of glazing sheet edges, and a corner cut spaces apart intersecting keder edges to enable window panel assembly by sliding all of the keder edges into keder channels of corresponding frame pieces.

2. The insulating window panel of claim 1 further comprising:

a compressible weatherstrip extending laterally outward from a weatherstrip side of frame pieces that form a perimeter of the assembled window panel;

wherein the weatherstrip comprises at least a first longitudinal fin extending laterally outward to a width Lw, and having a concave-frontward shape that curves toward a front frame side as it extends outward, the front side being the side that faces away from the built in window when the window panel is installed.

3. The insulating window panel of claim 2 wherein:

the at least first fin is made of a soft resilient material of medium grade hardness according to the ASTM D1056 scale.

4. The insulating window panel of claim 2 wherein the weatherstrip further comprises:

a thinnest portion of the first fin being at a laterally outward tip thereof; and a second longitudinal fin positioned frontward of the first fin, and extending laterally outward to a flared thickest portion at the width Lw, and having a concave-frontward shape that curves toward a front frame side as it extends outward.

5. The insulating window panel of claim 1 further comprising:

joints wherein adjoined frame pieces form a mitered corner; and a rabbet in a back side of the frame, the rabbet extending from the keder slot to the glazing side of the frame, the back side being the side that faces the built in window when the window panel is installed.

6. The insulating window panel of claim 5, wherein:

the corner cut spaces apart intersecting keder edges by a perpendicular spacing Cs that is no less than about twice the slot depth Sd that is measured from the keder slot intersection with the channel to the back side of the frame piece.

7. The insulating window panel of claim 5 further comprising:

a locking keyhole that spans a mitered frame joint for locking the adjoined frame pieces in a fixed configuration by inserting a locking key into the keyhole.

8. The insulating window panel of claim 1 further comprising:

joints wherein adjoined frame pieces form a butt joint.

9. The insulating window panel of claim 8 wherein the butt joint comprises:

a tongue extending longitudinally from a frame piece end; and a longitudinal tongue-receiving groove that is recessed in the glazing side of a frame piece.

10. The insulating window panel of claim 1 wherein:

the window recess has an opening size comprising a maximum height H and a maximum width W measured between opposed sidewalls;

the weatherstrip extends outward to a width Lw from the weatherstrip side of frame pieces; and the frame pieces are configured such that when assembled, the window panel including the weatherstrip has outside panel dimensions that exceed the opening size by a weatherstrip margin Wm that equals at least about one eighth of one weatherstrip width Lw, but no more than 1.5 times Lw.

11. The insulating window panel of claim 10 wherein:

the weatherstrip width Lw is about a half inch and the weatherstrip margin Wm is about one eighth inch.

12. A method of providing a custom size insulating window panel for removable installation by a user in a custom size window opening around a built-in window, wherein the window opening comprises a recess defined by perpendicular side walls surrounding it, the method comprising the steps of:

the user determining a custom window size H×W by making a plurality of spaced apart measurements Hi and Wi of window opening dimensions between opposed side walls thereof;

an offsite manufacturer prefabricating custom size panel components for the user to assemble and install, wherein prefabricating comprises the method steps of:

a) defining the custom window size dimensions H and W as the maximum one of the Hi measurements, and the maximum one of the Wi measurements, respectively;

b) preparing a plurality of longitudinally extending frame pieces configured with joints for interconnecting the frame pieces to form a window frame, and wherein each one of the frame pieces has a longitudinally extending keder channel with a longitudinal keder slot that opens out of a glazing side of each frame piece;

c) forming a compressible resilient weatherstrip that extends laterally outward to a width Lw from a weatherstrip side of frame pieces that form a perimeter of the window panel, the weatherstrip comprising a longitudinal fin that curves toward a front side of the frame pieces as it extends laterally, the frame front side being the side that faces away from the built in window when the panel is installed;

d) cutting out a pane of flexible glazing sheet having a plurality of sheet edges corresponding to a plurality of frame pieces that will surround the pane, and dimensioned according to a predetermined relationship with the custom window size dimensions;

e) making a kedered glazing sheet by forming a kedered edge bead on each of the cut glazing sheet edges, and by making corner cuts that space apart ends of intersecting keder beads, all being shaped and sized for sliding each keder edge bead in the keder channel of each corresponding frame piece such that the frame pieces form joints at the intersecting keder edges, and when fully assembled as a window frame, the frame pieces are pulled together at the joints by tension relative to the glazing sheet;

f) configuring the frame pieces such that, when assembled, the window frame with a perimeter weatherstrip has outside panel dimensions that exceed the custom window size H×W by a weatherstrip margin Wm that is no more than 1.5 times Lw; and g) bundling the custom size prefabricated frame pieces with weatherstripping and kedered glazing sheet for packing and shipping in a compact linear form;

thereby providing on-site a kit that enables the user to complete the method steps of:

h) on-site assembly of the custom insulating window panel by sliding kedered glazing sheet edges into weatherstripped frame piece keder channels and pulling the glazing sheet taut by aligning the frame pieces at the joints; and removable installation over the custom size built-in window by pressing the assembled insulating window panel into the window opening recess where it is removably held due to friction from the perimeter weatherstrip that is compressed by at least the weatherstrip margin Wm within the recess walls.

13. The method of claim 12 wherein:

the frame piece joints comprised mitered ends;

a back side of at least one of the frame pieces has a rabbet extending from the keder channel to the glazing side of the frame pieces, for allowing the glazing sheet to extend out of the frame piece back side during frame assembly, wherein a slot depth is defined as the distance from the frame piece back side to the keder channel; and the corner cut keder spacing is no less than about twice the slot depth.

14. The method of claim 13 wherein:

the slot depth is about 1/16 inch;

the weatherstrip extension width Lw is about ½ inch;

the weatherstrip fin thickness Ft averages about 1/16 inch;

the weatherstrip margin Wm is about ⅛ inch; and a joint lock is applied during assembly to hold frame joints in alignment.

15. The method of claim 12 wherein:

the frame piece joints are butt joints;

the keder slot opens out through a butt joint groove that extends in parallel with the keder channel and keder slot along the length of the glazing side of the frame pieces; and the corner cut keder spacing is no less than a slot depth being the length of the keder slot from the keder channel to the butt joint groove.

16. The method of claim 15 wherein:

the butt joints are reinforced butt joints comprising a tongue extending longitudinally from a frame piece end, and being configured for joining engagement in the butt joint groove.

17. The method of claim 12 wherein:

a non-rectangular window opening is accommodated by adapting the definition of custom size H×W to comprise a set of dimensions suitable for defining the shape and size of the non-rectangular custom window opening.

* * * * *